US010474056B2

(12) United States Patent
Uematsu et al.

(10) Patent No.: US 10,474,056 B2
(45) Date of Patent: Nov. 12, 2019

(54) IMAGE FORMING APPARATUS

(71) Applicants: Yuuichiroh Uematsu, Kanagawa (JP); Satoshi Kaneko, Kanagawa (JP); Terumichi Ochi, Kanagawa (JP); Shuji Hirai, Tokyo (JP)

(72) Inventors: Yuuichiroh Uematsu, Kanagawa (JP); Satoshi Kaneko, Kanagawa (JP); Terumichi Ochi, Kanagawa (JP); Shuji Hirai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/227,980

(22) Filed: Dec. 20, 2018

(65) Prior Publication Data

US 2019/0196355 A1 Jun. 27, 2019

(30) Foreign Application Priority Data

Dec. 21, 2017 (JP) ..... 2017-244976

(51) Int. Cl.
*G03G 15/04* (2006.01)
*G03G 15/043* (2006.01)
*G03G 15/00* (2006.01)

(52) U.S. Cl.
CPC ..... *G03G 15/043* (2013.01); *G03G 15/04072* (2013.01); *G03G 15/5058* (2013.01); (Continued)

(58) Field of Classification Search
CPC ..... G03G 15/043; G03G 15/04072; G03G 15/5058; G03G 2215/00029; G03G 2215/00033; G03G 2215/00037
See application file for complete search history.

(56) References Cited

U.S. PATENT DOCUMENTS

2010/0329712 A1* 12/2010 Fukutani ..... G03G 15/0131 399/49
2011/0052231 A1 3/2011 Kitao
(Continued)

FOREIGN PATENT DOCUMENTS

EP 2 639 645 A2 9/2013
JP 2000-098675 4/2000
(Continued)

OTHER PUBLICATIONS

Extended European Search Report dated Jun. 25, 2019 in Patent Application No. 18213485.8, citing documents AA, AB, and AO therein, 6 pages.

*Primary Examiner* — Hoang X Ngo
(74) *Attorney, Agent, or Firm* — Oblon, McClelland, Maier & Neustadt, L.L.P.

(57) ABSTRACT

An image forming apparatus includes a latent image bearer; a writing device configured to write a latent image onto the latent image bearer; a detection device configured to detect, at a plurality of positions, a density of a toner image obtained through development of the latent image; and a controller configured to correct a writing intensity of the writing device to correct an uneven density based on detection values of the detection device. The controller determines whether each of the detection values is pass or fail. In response to a determination that a detection value is fail, the controller corrects the wiring intensity based on another detection value determined to be pass at a position different from a position at which the detection value is determined to be fail, instead of correcting the writing intensity based on the detection value determined to be fail.

10 Claims, 21 Drawing Sheets

(52) U.S. Cl.
CPC ..... *G03G 2215/00033* (2013.01); *G03G 2215/00037* (2013.01)

(56) References Cited

U.S. PATENT DOCUMENTS

| | | | | |
|---|---|---|---|---|
| 2013/0243459 | A1 | 9/2013 | Omori et al. | |
| 2013/0302052 | A1 | 11/2013 | Iwata et al. | |
| 2014/0270827 | A1* | 9/2014 | Muto | G03G 15/5058 399/49 |
| 2015/0212470 | A1* | 7/2015 | Dobbertin | G03G 15/55 399/49 |
| 2015/0261162 | A1 | 9/2015 | Kaneko et al. | |
| 2017/0248889 | A1 | 8/2017 | Uematsu et al. | |
| 2017/0269527 | A1 | 9/2017 | Kaneko et al. | |
| 2017/0315471 | A1 | 11/2017 | Kamihara et al. | |
| 2018/0136593 | A1 | 5/2018 | Kaneko et al. | |
| 2018/0150010 | A1 | 5/2018 | Sone et al. | |

FOREIGN PATENT DOCUMENTS

| | | |
|---|---|---|
| JP | 2007-322745 | 12/2007 |
| JP | 2012-226232 | 11/2012 |
| JP | 2013-195585 | 9/2013 |
| JP | 2013-235167 | 11/2013 |

* cited by examiner

| FIG. 7A |
| --- |
| FIG. 7B |

IMAGE FORMING APPARATUS

CROSS-REFERENCE TO RELATED APPLICATION

This patent application is based on and claims priority pursuant to 35 U.S.C. § 119(a) to Japanese Patent Application No. 2017-244976, filed on Dec. 21, 2017, in the Japan Patent Office, the entire disclosure of which is incorporated by reference herein.

BACKGROUND

Technical Field

The present disclosure relates to an image forming apparatus.

Related Art

There is known an image forming apparatus having the following structure. That is, the image forming apparatus includes a writing member that writes a latent image onto a latent image bearer, and a detection member that detects a density of a toner image, which is obtained by developing the latent image, at a plurality of positions. The image forming apparatus corrects a writing intensity of the writing member to correct an uneven density from a detection value of the detection member.

SUMMARY

According to an aspect of the present disclosure, there is provided an image forming apparatus that includes a latent image bearer, a writing device, a detection device, and a controller. The writing device is configured to write a latent image onto the latent image bearer. The detection device is configured to detect, at a plurality of positions, a density of a toner image obtained through development of the latent image. The controller is configured to correct a writing intensity of the writing device to correct an uneven density based on detection values of the detection device. The controller is configured to determine whether each of the detection values of the detection device is pass or fail. The controller is configured to correct, in response to a determination that a detection value of the detection values is fail, the wiring intensity based on another detection value of the detection values determined to be pass at a position different from a position at which the detection value is determined to be fail, instead of correcting the writing intensity based on the detection value determined to be fail.

According to the present disclosure, an advantageous effect can be obtained that an uneven density is suppressed by correcting a writing intensity of a latent image even when a detection value of a density of a toner image includes a measurement error.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 17 containing

Figure 1:
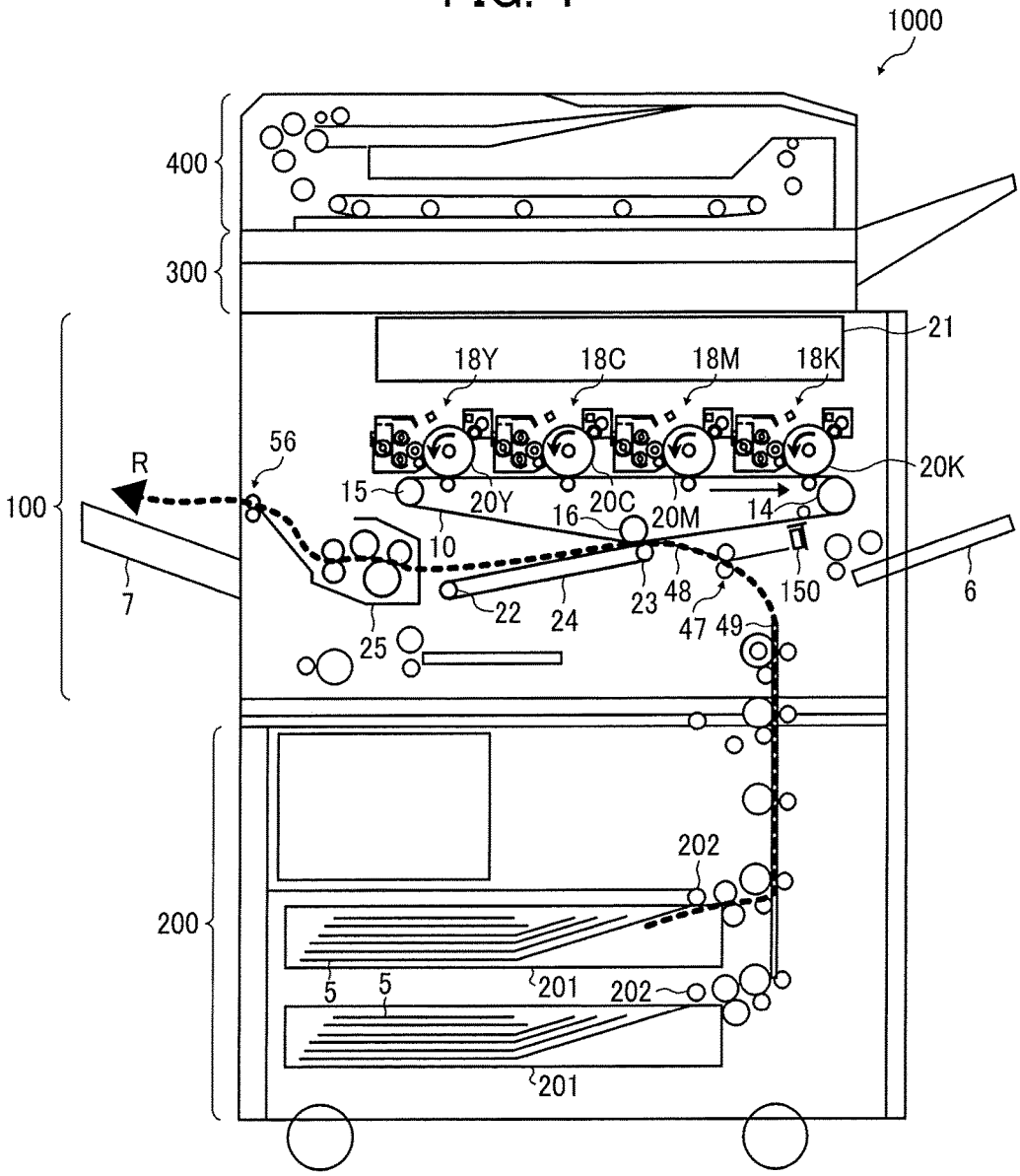
FIG. 1 is a schematic configuration diagram illustrating an image forming apparatus according to an embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an image forming apparatus according to an embodiment of the present disclosure is described with reference to an example of an electrophotographic full-color copying machine (hereinafter referred to simply as a copying machine).

First, a basic structure of an image forming apparatus according to an embodiment of the present disclosure will be described. FIG. 1 is a schematic configuration diagram illustrating the image forming apparatus according to the present embodiment. Referring to FIG. 1, the image forming apparatus 1000 includes an image forming unit 100 that forms an image on a recording sheet, a sheet feeding device 200 that supplies recording sheets 5 to the image forming unit 100, and a scanner 300 that reads an image formed on a document. The image forming apparatus 1000 also includes an automatic document feeder (ADF) 400 that is attached to an upper portion of the scanner 300. The image forming unit 100 is provided with a bypass feeding tray 6 to manually set the recording sheets 5, a stack tray 7 to stack the recording sheets 5 each having an image formed thereon, and the like.

Figure 2:
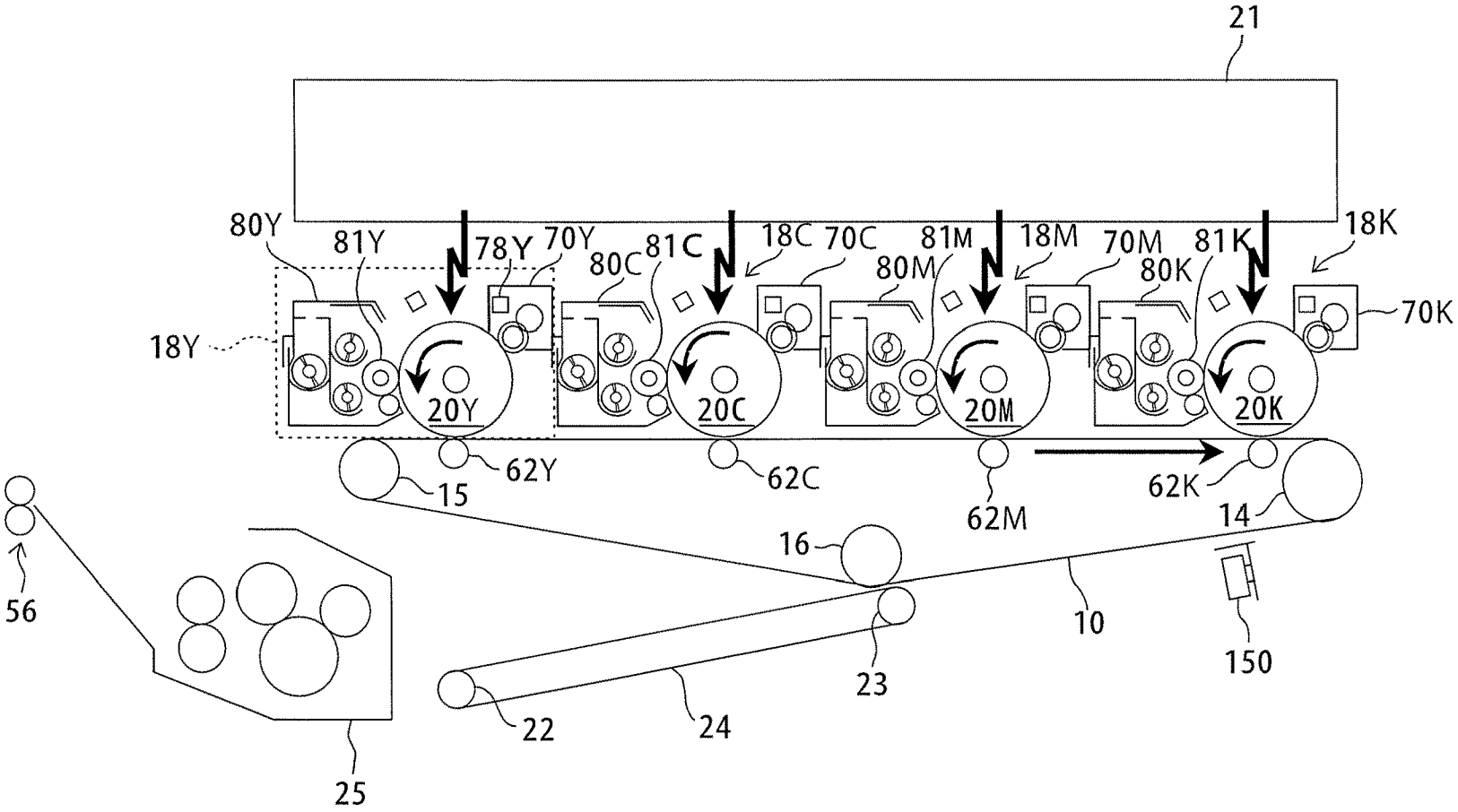
FIG. 2 is an enlarged configuration diagram illustrating an image forming unit of the image forming apparatus.

FIG. 2 is an enlarged configuration diagram illustrating the image forming unit 100. The image forming unit 100 is provided with a transfer unit including an endless intermediate transfer belt 10. The intermediate transfer belt 10 of the transfer unit is stretched around three support rollers (14, 15, and 16) and is rotationally driven by one of the support rollers and is thus caused to move endlessly clockwise in FIGS. 1 and 2. Four image forming units for yellow (Y), cyan (C), magenta (M), and black (K) are opposed to the outer surface of a belt portion that moves between the first support roller 14 and the second support roller 15 out of the three support rollers (14, 15, and 16). An optical sensor unit 150 that detects an image density (a toner adhesion amount per unit area) of a toner image formed on the intermediate transfer belt 10 is opposed to the outer surface of a belt portion that moves between the first support roller 14 and the third support roller 16.

Four image forming units 18Y, 18C, 18M, and 18K have substantially the same structure except that the image forming units use different colors of toner. For example, the image forming unit 18Y for yellow (Y) that forms a Y-toner image includes a photoconductor 20Y, a charging device 70Y, and a developing device 80Y.

The surface of the photoconductor 20Y is uniformly charged to a negative polarity by the charging device 70Y. On the uniformly charged surface of the photoconductor 20Y, a potential of a portion irradiated with a laser beam from a laser writing device 21 is attenuated to obtain an electrostatic latent image.

Referring to FIG. 1, the laser writing device 21 is provided above the image forming units 18Y, 18C, 18M, and 18K. The laser writing device 21 emits writing light based on image information about a document read by the scanner 300, or image information sent from an external device, such as a personal computer. Specifically, based on image information, a laser controller drives a semiconductor laser to emit writing light. Further, the writing light exposes and scans each of the drum-shaped photoconductors 20Y, 20C, 20M, and 20K, which are latent image bearers formed on the image forming units 18Y, 18C, 18M, and 18K, respectively, thereby forming an electrostatic latent image thereon. The light source of the writing light is not limited to a laser diode, but instead may be, for example, a light-emitting diode (LED).

Figure 3:
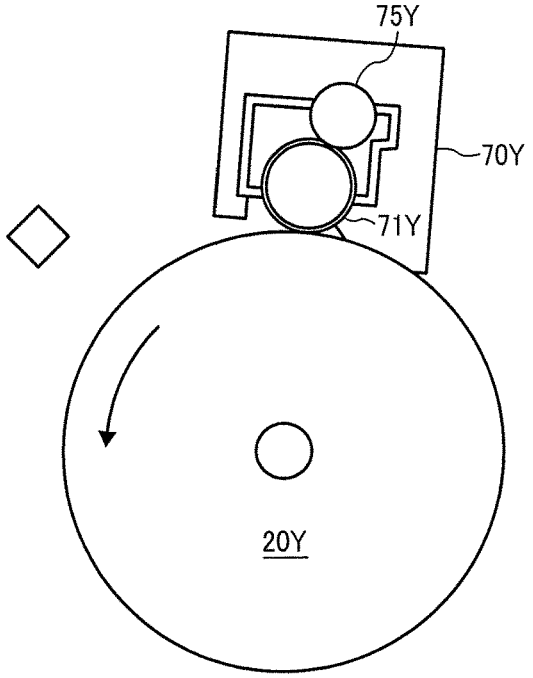
FIG. 3 is an enlarged configuration diagram illustrating a photoconductor and a charging device for yellow (Y) in the image forming unit.

FIG. 3 is an enlarged configuration diagram illustrating the photoconductor 20Y and the charging device 70Y for yellow (Y). The charging device 70Y includes a charging roller 71Y that contacts the photoconductor 20Y to rotate following the rotation of the photoconductor 20Y, and a charging cleaning roller 75Y that contacts the charging roller 71Y to rotate following the rotation of the charging roller 71Y.

The charging cleaning roller 75Y of the charging device 70Y includes a conductive cored bar and an elastic layer coated on the peripheral surface of the core metal. The elastic layer, which is a sponge-like member produced by performing a microcellular foaming process on melamine resin, rotates while contacting the charging roller 71Y. Along with the rotation, the charging cleaning roller 75Y removes dust, residual toner, and the like from the charging roller 71Y to thereby suppress the creation of an abnormal image.

Figure 4:
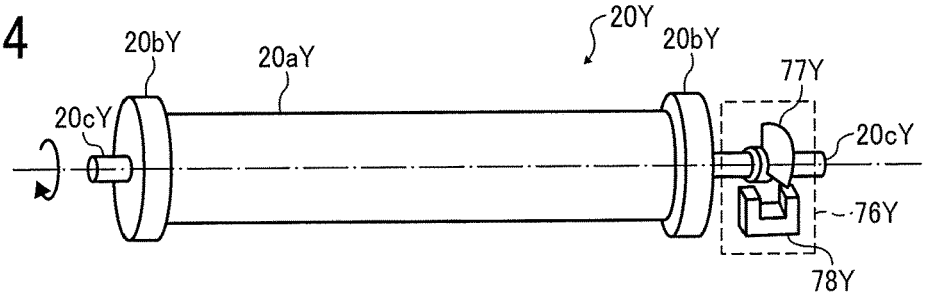
FIG. 4 is an enlarged perspective view illustrating the photoconductor.

FIG. 4 is an enlarged perspective view illustrating the photoconductor 20Y for yellow (Y). The photoconductor 20Y includes a columnar body portion 20*a*Y, large-diameter flange portions 20*b*Y disposed at both ends of the body portion 20*a*Y in the rotational axial direction of the body portion, and a rotation shaft member 20*c*Y.

One of the rotation shaft members 20*c*Y, which protrude from end faces of the two flange portions 20*b*Y, respectively, penetrates a photoconductor rotation sensor 76Y, and the portion protruding from the photoconductor rotation sensor 76Y is received by a bearing. The photoconductor rotation sensor 76Y includes a light shielding member 77Y and a transmission photosensor 78Y. The light shielding member 77Y secured to the rotation shaft member 20*c*Y has a shape protruding from a predetermined position on the peripheral surface of the rotation shaft member 20*c*Y in the normal direction. When the photoconductor 20Y takes a predetermined rotation attitude, the light shielding member 77Y is interposed between a light-emitting element and a light-receiving element of the transmission photosensor 78Y. With this structure, when the light-receiving element does not receive light, the value of a voltage output from the transmission photosensor 78Y decreases significantly. Specifically, detecting the photoconductor 20Y being in a predetermined rotation attitude, the transmission photosensor 78Y significantly decreases the output voltage value.

Figure 5:
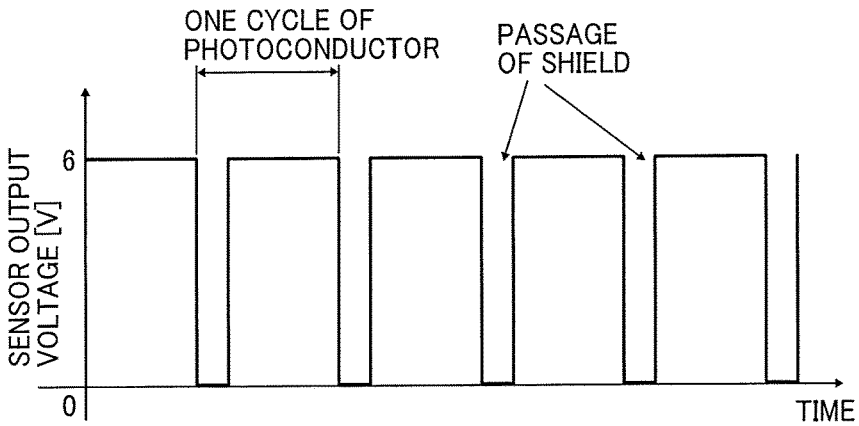
FIG. 5 is a schematic graph illustrating a change over time in an output voltage from a photoconductor rotation sensor for yellow (Y) in the image forming unit.

FIG. 5 is a schematic graph illustrating a change over time in a voltage output from the photoconductor rotation sensor 76Y for yellow (Y). Specifically, the voltage output from the photoconductor rotation sensor 76Y is a voltage output from the transmission photosensor 78Y. As illustrated in FIG. 5, the photoconductor rotation sensor 76Y outputs a voltage of 6 V when the photoconductor 20Y rotates (revolves). However, each time the photoconductor 20Y makes a complete turn, the voltage output from the photoconductor rotation sensor 76Y instantaneously falls to nearly 0 V. Specifically, each time the photoconductor 20Y makes a complete turn, the light shielding member 77Y is interposed between the light-emitting element and the light-receiving element of the photoconductor rotation sensor 76Y, thereby blocking the light to be received by the light-receiving element. The output voltage greatly decreases at a timing when the photoconductor 20Y is in a predetermined rotation attitude. This timing is hereinafter referred to as a "reference attitude timing".

Figure 6:
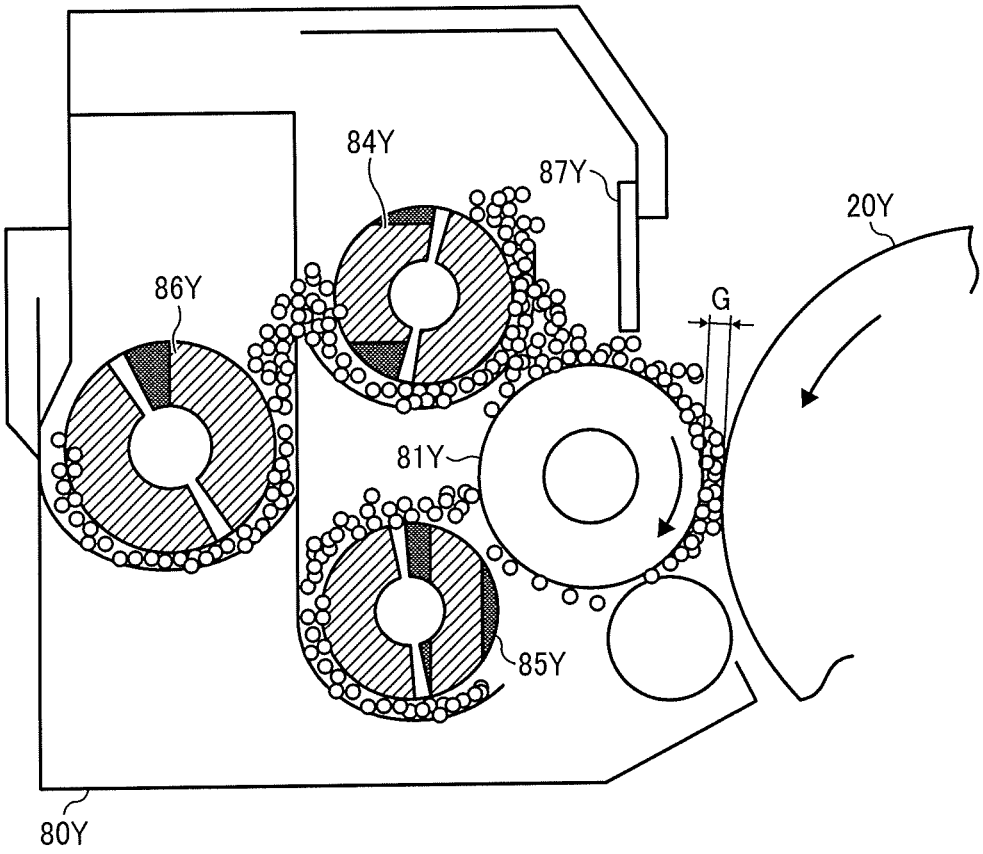
FIG. 6 is a configuration diagram illustrating the vicinity of a center in a longitudinal direction of a developing device for yellow (Y) in the image forming unit, and a part of the photoconductor.

FIG. 6 is a configuration diagram illustrating the vicinity of the center in the longitudinal direction of the developing device 80Y for yellow (Y), and a part of the photoconductor 20Y for yellow (Y). The developing device 80Y employs two-component development in which two-component developer containing magnetic carriers and nonmagnetic toner is used for image developing. Alternatively, one-component development using one-component developer that does not contain magnetic carriers may be employed. The developing device 80Y includes a stirring unit and a developing unit within a development case. In the stirring unit, the two-component developer (hereinafter referred to simply as "developer") is stirred by three screw members and is conveyed to the developing unit.

The developing unit includes a developing sleeve 81Y which is a developing member that rotates (revolves) while a part of the peripheral surface of the developing sleeve is disposed opposite to the photoconductor 20Y via an opening of the developing device body case across a predetermined development gap G. The developing sleeve 81Y serving as a developer bearer includes a magnet roller which does not rotate together with the developing sleeve 81Y.

A supply screw 84Y and a collecting screw 85Y in the stirring unit and the developing sleeve 81Y in the developing unit extend in a horizontal direction and are disposed in parallel to each other. On the other hand, a stirring screw 86Y in the stirring unit is disposed in an inclined attitude to rise from the front side to the backside in the direction perpendicular to the drawing sheet in FIG. 6.

Along with the rotation, the supply screw 84Y of the stirring unit conveys the developer from the backside to the front side in the direction perpendicular to the drawing sheet to supply the developer to the developing sleeve 81Y of the developing unit. The developer that is not supplied to the developing sleeve 81Y but is conveyed to the front end of the development case in the above-mentioned direction in the developing device falls to the collecting screw 85Y disposed immediately below the supply screw 84Y.

The developer supplied to the developing sleeve 81Y by the supply screw 84Y of the stirring unit is scooped up onto the surface of the developing sleeve 81Y due to the magnetic force exerted by the magnet roller included in the sleeve. The magnetic force of the magnet roller causes the developer, which is scooped up onto the surface of the developing sleeve 81Y, to stand on end due to the magnetic force generated by the magnetic roller, thereby forming a magnetic brush. As the developing sleeve 81Y rotates, the developer passes through a regulation gap formed between a leading end of a regulation blade 87Y and the developing sleeve 81Y, where the thickness of the layer of the developer on the developing sleeve 81Y is regulated. Then, the developer is conveyed to a developing area opposite the photoconductor 20Y.

In the developing area, the toner locating facing the electrostatic latent image formed on the photoconductor 20Y adheres to the photoconductor 20Y due to a developing potential that provides an electrostatic force trending to the electrostatic latent image on the photoconductor 20Y by a development bias applied to the developing sleeve 81Y. Further, the toner locating facing a background on the photoconductor 20Y does not adhere to the photoconductor 20Y due to a background potential that gives an electrostatic force trending to the sleeve surface. As a result, the toner is transferred onto the electrostatic latent image on the photoconductor 20Y to develop the electrostatic latent image. In this manner, a Y-toner image is formed on the photoconductor 20Y. The Y-toner image enters a primary transfer nip for yellow (Y) to be described below as the photoconductor 20Y rotates.

As the developing sleeve 81Y rotates, the developer that has passed through the developing area is conveyed to an area where the magnetic force of the magnet roller is weaker. Then, the developer leaves the surface of the developing sleeve 81Y and returns to the collecting screw 85Y of the stirring unit. While rotating, the collecting screw 85Y conveys the developer collected from the developing sleeve 81Y from the backside to the front side of the drawing sheet of FIG. 6. At the front end of the developing device 80Y in the above-mentioned direction, the developer is delivered to the stirring screw 86Y.

The developer delivered from the collecting screw 85Y to the stirring screw 86Y is conveyed to the back side from the front side in the above-mentioned direction along with the rotation of the stirring screw 86Y. In this process, the concentration of toner is detected by a toner concentration sensor (82Y in FIG. 7 to be described below) composed of the magnetic permeability sensor, and based on the detection result, an appropriate amount of toner is supplied. Specifically, to supply toner, a controller (110 in FIG. 7) drives a toner supply device based on the detection result from the toner concentration sensor. The developer to which an appropriate amount of toner is supplied is conveyed to the back end in the above-mentioned direction and is delivered to the supply screw 84Y.

The image formation for a Y-toner image in the image forming unit 18Y for yellow (Y) has been described above. By a process similar to that for the image forming unit 18Y, the image forming units 18C, 18M, and 18K form a C-toner image, an M-toner image, and a K-toner image on the surfaces of the photoconductors 20C, 20M, and 20K, respectively.

Referring to FIG. 2, the formed toner image is transferred onto the intermediate transfer belt 10. A primary transfer roller 62Y for yellow (Y) is disposed inside the loop of the intermediate transfer belt 10, and the intermediate transfer belt 10 is sandwiched between the primary transfer roller 62Y for yellow (Y) and the photoconductor 20Y for yellow (Y). With this structure, a primary transfer nip for yellow (Y) at which the outer surface of the intermediate transfer belt 10 and the photoconductor 20Y for yellow (Y) contact is formed. Further, between the primary transfer roller 62Y for yellow (Y) to which a primary transfer bias is applied and the photoconductor 20Y, a primary transfer field is formed. Similarly, a primary transfer electric field is formed between primary transfer rollers 62C, 62M, and 62K for cyan (C), magenta (M), and black (K), and between the photoconductors 20C, 20M, and 20K.

The outer surface of the intermediate transfer belt 10 sequentially passes through the primary transfer nips for yellow (Y), cyan (C), magenta (M), and black (K) along with an endless movement of the belt. In this process, Y-toner image, the C-toner image, the M-toner image, and the K-toner image formed on the photoconductors 20Y, 20C, 20M, and 20K, respectively, are sequentially superimposed on the outer surface of the intermediate transfer belt 10 and are primarily transferred. As a result, four-color toner images are formed in a superimposed manner on the outer surface of the intermediate transfer belt 10.

An endless conveyor belt 24 stretched around a first suspension roller 22 and a second suspension roller 23 is disposed below the intermediate transfer belt 10, and is caused to move endlessly counterclockwise in FIG. 2 as the suspension rollers are rotationally driven. Then, the outer surface of the endless conveyor belt 24 contacts a portion of the intermediate transfer belt 10 wound around the third support roller 16, and the contact portion forms a secondary transfer nip. In the vicinity of the secondary transfer nip, a secondary transfer electric field is formed between the grounded second suspension roller 23 and the third support roller 16 to which a secondary transfer bias is applied.

Referring to FIG. 1, in the sheet feeding device 200 and the image forming unit 100, a sheet conveyance path through which the recording sheet 5 delivered from the sheet feeding device 200 is ejected to the outside through the inside of the image forming unit 100 is formed. In the image forming unit 100, a conveyance path 48 and a feeding path 49 which constitute a part of the sheet conveyance path are provided. The conveyance path 48 is used to sequentially convey the recording sheets 5 fed from the sheet feeding device 200 and the bypass feeding tray 6 to the above-described secondary transfer nip, a fixing device 25, and a ejection roller pair 56. Further, the feeding path 49 is used to convey the recording sheets 5 fed from the sheet feeding device 200 to the image forming unit 100 to an entrance of the conveyance path 48. At the entrance of the conveyance path 48, a registration roller pair 47 is disposed.

When a print job is started, the recording sheets 5 fed from the sheet feeding device 200 or the bypass feeding tray 6 are conveyed toward the conveyance path 48 and contact the registration roller pair 47. Then, the registration roller pair 47 starts the rotation driving at an appropriate timing, thereby sending the recording sheets 5 toward the secondary transfer nip. In the secondary transfer nip, four-color superimposed toner images on the intermediate transfer belt 10 adhere tightly to each recording sheet 5. Further, the four-color superimposed toner images are secondarily transferred onto the surface of the recording sheet 5 due to the secondary transfer electric field and nip pressure. Thus, a full-color toner image is formed on the recording sheet 5.

The recording sheet 5 which has passed through the secondary transfer nip is conveyed to the fixing device 25 by the conveyor belt 24. Then, the recording sheet 5 is pressurized and heated in the fixing device 25, so that the full-color toner image is fixed onto the surface of the recording sheet 5. After that, the recording sheet 5 is ejected from the fixing device 25 and is stacked on the stack tray 7 through the ejection roller pair 56.

Figures 7, 7A:
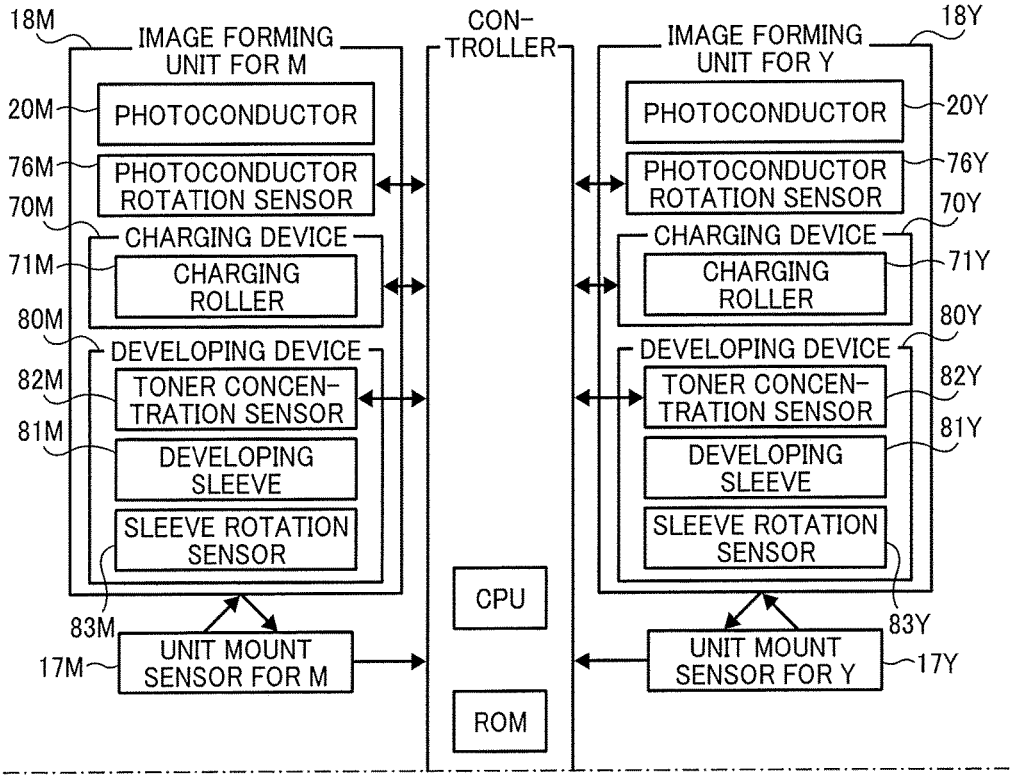
FIG. 7 containing
FIGS. 7A and 7B is a block diagram illustrating a major part of an electric circuit of the image forming apparatus.
Figure 7B:
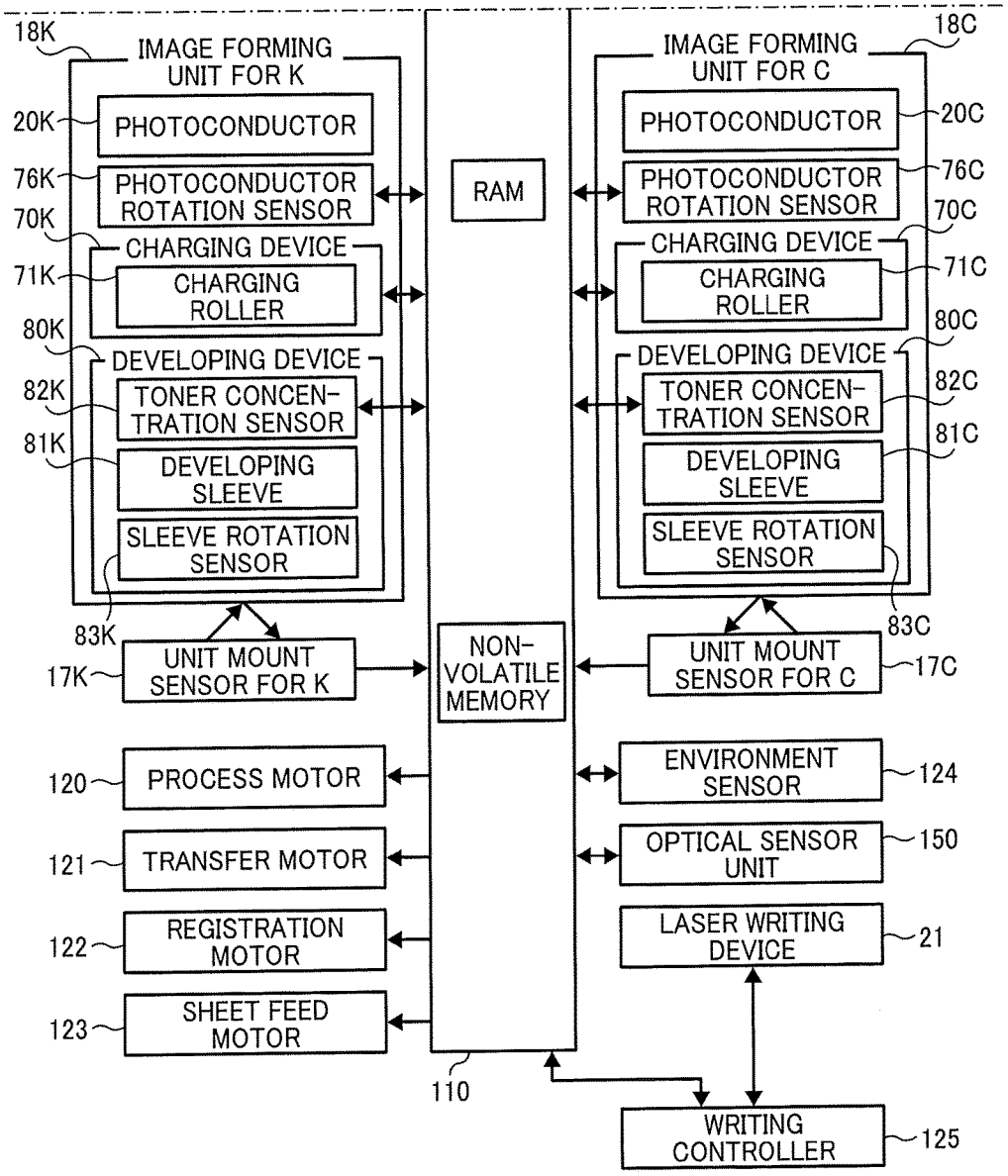

FIG. 7 is a block diagram illustrating a major part of an electric circuit of the image forming apparatus according to the present embodiment. In FIG. 7, a controller 110 serving as a control unit includes a central processing unit (CPU), a random access memory (RAM), a read-only memory (ROM), and a nonvolatile memory. The controller 110 is electrically connected to toner concentration sensors 82Y, 82C, 82M, and 82K of the developing devices 80Y, 80C, 80M, and 80K for yellow (Y), cyan (C), magenta (M), and black (K). With this structure, the controller 110 can detect the toner density of Y-developer, C-developer, M-developer, and K-developer which are housed in the developing devices 80Y, 80C, 80M, and 80K for yellow (Y), cyan (C), magenta (M), and black (K), respectively.

The controller 110 is also electrically connected to unit mount sensors 17Y, 17C, 17M, and 17K for yellow (Y), cyan (C), magenta (M), and black (K). The unit mount sensors 17Y, 17C, 17M, and 17K each serving as a mount detection sensor can detect detachment of the image forming units 18Y, 18C, 18M, and 18K from the image forming unit 100. The unit mount sensors 17Y, 17C, 17M, and 17K can also detect attachment of the image forming units 18Y, 18C, 18M, and 18K to the image forming unit 100. With this structure, the controller 110 can detect attachment/detachment of the image forming units 18Y, 18C, 18M, and 18K to/from the image forming unit 100.

The controller 110 is also electrically connected to the photoconductor rotation sensor 76Y. The photoconductor rotation sensor 76Y detects a predetermined rotational attitude of the photoconductor 20Y. Then, the controller 110 receives the detection output from the photoconductor rotation sensor 76Y. Similarly, the photoconductor rotation sensors 76C, 76M, and 76K for cyan (C), magenta (M), and black (K) detect predetermined rotational attitudes of the photoconductors 20C, 20M, and 20K, respectively.

The controller 110 is also electrically connected to a sleeve rotation sensor 83Y. The sleeve rotation sensor 83Y serving as a rotational attitude detection unit has a structure similar to that of the photoconductor rotation sensor 76Y, and detects a predetermined rotational attitude of the developing sleeve 81Y. Then, the controller 110 receives the detection output from the sleeve rotation sensor 83Y. Similarly, the sleeve rotation sensors 83C, 83M, and 83K for cyan (C), magenta (M), and black (K) detect predetermined rotational attitudes of developing sleeves 81C, 81M, and 81K, respectively.

The controller 110 is also electrically connected to a writing controller 125, an environment sensor 124, an optical sensor unit 150, a process motor 120, a transfer motor 121, a registration motor 122, a sheet feed motor 123, and the like. The environment sensor 124 detects the temperature and humidity within the apparatus. The process motor 120 is a motor serving as a drive source for the image forming units 18Y, 18C, 18M, and 18K. The transfer motor 121 is a motor serving as a drive source for the intermediate transfer belt 10. The registration motor 122 is a motor serving as a drive source for the registration roller pair 47. The sheet feed motor 123 is a motor serving as a drive source for a pickup roller 202 for delivering the recording sheet 5 from a sheet feeding cassette 201 of the sheet feeding device 200. The writing controller 125 controls driving of the laser writing device 21 based on image information. The role of the optical sensor unit 150 will be described later.

Referring to FIG. 2, a development gap between the photoconductor 20Y and the developing sleeve 81Y slightly varies along with the rotation of the photoconductor 20Y for yellow (Y) and the rotation of the developing sleeve 81Y for yellow (Y). This is caused due to the eccentricity of the rotation axis or distortion of the peripheral surface shape of the photoconductor 20Y and the developing sleeve 81Y.

Development gaps for C, M, and K also vary along with the rotation of the photoconductors 20C, 20M, and 20K and the developing sleeves 81C, 81M, and 81K for cyan (C), magenta (M), and black (K).

Thus, when the development gaps for Y, C, M, and K vary, a periodic uneven density occurs in the toner images for Y, C, M, and K. This periodic uneven density is caused in such a manner that an uneven density that occurs in synchronization of the rotation cycle (predetermined cycle) of each of the photoconductors 20Y, 20C, 20M, and 20K and an uneven density that occurs in synchronization with the rotation cycle (predetermined cycle) of each of the developing sleeves 81Y, 81C, 81M, and 81K are superimposed.

Specifically, when the photoconductors 20Y, 20C, 20M, and 20K rotate, a development gap variation that repeatedly increases and decreases in a predetermined pattern per rotation of the photoconductors due to the eccentricity of the rotation axis, distortion of the peripheral surface shape, or the like. Due to the development gap variation, a strength variation that repeatedly increases and decreases in a predetermined pattern per rotation of the photo conductors occurs in the development electric field formed between the photoconductors 20Y, 20C, 20M, and 20K and the developing sleeves 81Y, 81C, 81M, and 81K. Due to the strength variation, a periodic uneven density that repeatedly increases and decreases in a predetermined density pattern per rotation of the photoconductors occurs. The density pattern is hereinafter referred to as a density variation pattern (detection value).

When the developing sleeves 81Y, 81C, 81M, and 81K rotate, a development gap variation that repeatedly increases and decreases in a predetermined pattern per rotation of the sleeves occurs due to the eccentricity of the rotation axis, distortion of the peripheral surface shape, or the like. Due to the development gap variation, a strength variation that repeatedly increases and decreases in a predetermined pattern per rotation of the sleeves occurs in the development electric field formed between the photoconductor 20Y, 20C, 20M, 20K and the developing sleeves 81Y, 81C, 81M, and 81K. Due to the strength variation, an uneven density of the density variation pattern in the sleeve rotation cycle occurs. The developing sleeves 81Y, 81C, 81M, and 81K have a diameter smaller than that of each of the photoconductors 20Y, 20C, 20M, and 20K. Accordingly, an uneven density of the density variation pattern along with the rotation of the sleeves occurs in a relatively short cycle, so that the density is repeated within a page. For this reason, it is easily visible (conspicuous) to human eyes.

Uneven density patterns appearing in the Y, C, M, and K-toner images are formed in such a manner that a density variation pattern that occurs in the rotation cycle of the photoconductors 20Y, 20C, 20M, and 20K and a density variation pattern that occurs in the rotation cycle of the developing sleeves 81Y, 81C, 81M, and 81K are superimposed.

To suppress the periodic uneven density as described above, the controller 110 executes light amount variation processing as described below so as to vary the light amount of writing light by the laser writing device 21 in a predetermined variation pattern for each of Y, C, M, and K during a print job Specifically, the controller 110 stores, for each color of Y, C, M, and K, light amount correction pattern data, which is capable of causing a periodic variation in the potential of an electrostatic latent image that offsets the uneven density occurring in a photoconductor rotation cycle, in the nonvolatile memory. Light amount correction pattern data capable of causing a periodic variation in the potential of an electrostatic latent image that offsets the uneven density occurring in a developing sleeve rotation cycle is also stored in the nonvolatile memory. The former light amount correction pattern data is hereinafter referred to as light amount correction pattern data for photoconductor cycle. The latter light amount correction pattern data is referred to as light amount correction pattern data for sleeve cycle.

Four pieces of light amount correction pattern data for photoconductor cycle respectively corresponding to Y, M, C, and K indicate patterns equivalent to one rotation cycle of the photoconductor, and also indicate data pattern based on a reference attitude timing of each of the photoconductors 20Y, 20C, 20M, and 20K. These pieces of light amount correction pattern data are data indicating a variation pattern of the superimposed light amount used when the reference light amount, which is a reference latent image writing intensity, is corrected by superimposing the superimposed light amounts. For example, in the case of data in a data table format, the data includes a group of data on differences in the light amount (in practice, differences in laser diode (LD) power) at predetermined intervals in a period equivalent to one photoconductor rotation cycle starting from the reference attitude timing. Leading data in the data group indicates the light amount difference at the reference attitude timing, and second data, third data, fourth data, and subsequent data indicate the light amount differences at the predetermined intervals subsequent to the reference attitude timing.

To simply suppress the uneven image density occurring in the photoconductor rotation cycle, the light amount of writing light output from the laser writing device 21 can be a value in which the values are superimposed with the reference light amount. In the image forming apparatus according the present embodiment, however, to suppress the uneven image density in the developing sleeve rotation cycle as well, the light amount difference for suppressing the uneven density in the photoconductor rotation cycle and the light amount difference for suppressing the uneven density in the developing sleeve rotation cycle are superimposed.

Four pieces of light amount correction pattern data for sleeve cycle respectively corresponding to Y, C, M, and K indicate patterns equivalent to one rotation cycle of the developing sleeve and also indicate pattern data based on the reference attitude timing of the developing sleeves 81Y, 81C, 81M, and 81K. These pieces of light amount correction pattern data are data indicating a variation pattern of the superimposed light amount superimposed on the reference light amount. For example, in the case of data in a data table format, leading data in the data group indicates the light amount difference at the reference attitude timing, and second data, third data, fourth data, and subsequent data indicate the light amount differences at the predetermined intervals subsequent to the reference attitude timing. The intervals are identical to the intervals reflected in the data group in the light amount correction pattern data for photoconductor cycle.

In image formation processing, the controller 110 reads data from the light amount correction pattern data for photoconductor cycle respectively corresponding to Y, C, M, and K at predetermined intervals. Simultaneously, the controller 110 reads data from the light amount correction pattern data for sleeve cycle respectively corresponding to Y, C, M, and K at the same intervals. In reading the data, in a case where the reference attitude timing does not arrive even after the last data of the data group is read, the controller 110 sets the read value identical to the last data until the reference attitude timing arrives. In a case where the reference attitude timing arrives before the last data of the data group is read, the data read position is returned to the initial data. Regarding the reading of data from the light amount correction pattern data for photoconductor cycle, a timing when the photoconductor rotation sensor (76Y, 76C, 76M, 76K) transmits a reference attitude timing signal is used as the reference attitude timing. Regarding the reading of data from the light amount correction pattern data for sleeve cycle, a timing when the sleeve rotation sensor (83Y, 83C, 83M, 83K) transmits the reference attitude timing signal is used as the reference attitude timing.

Figure 8:
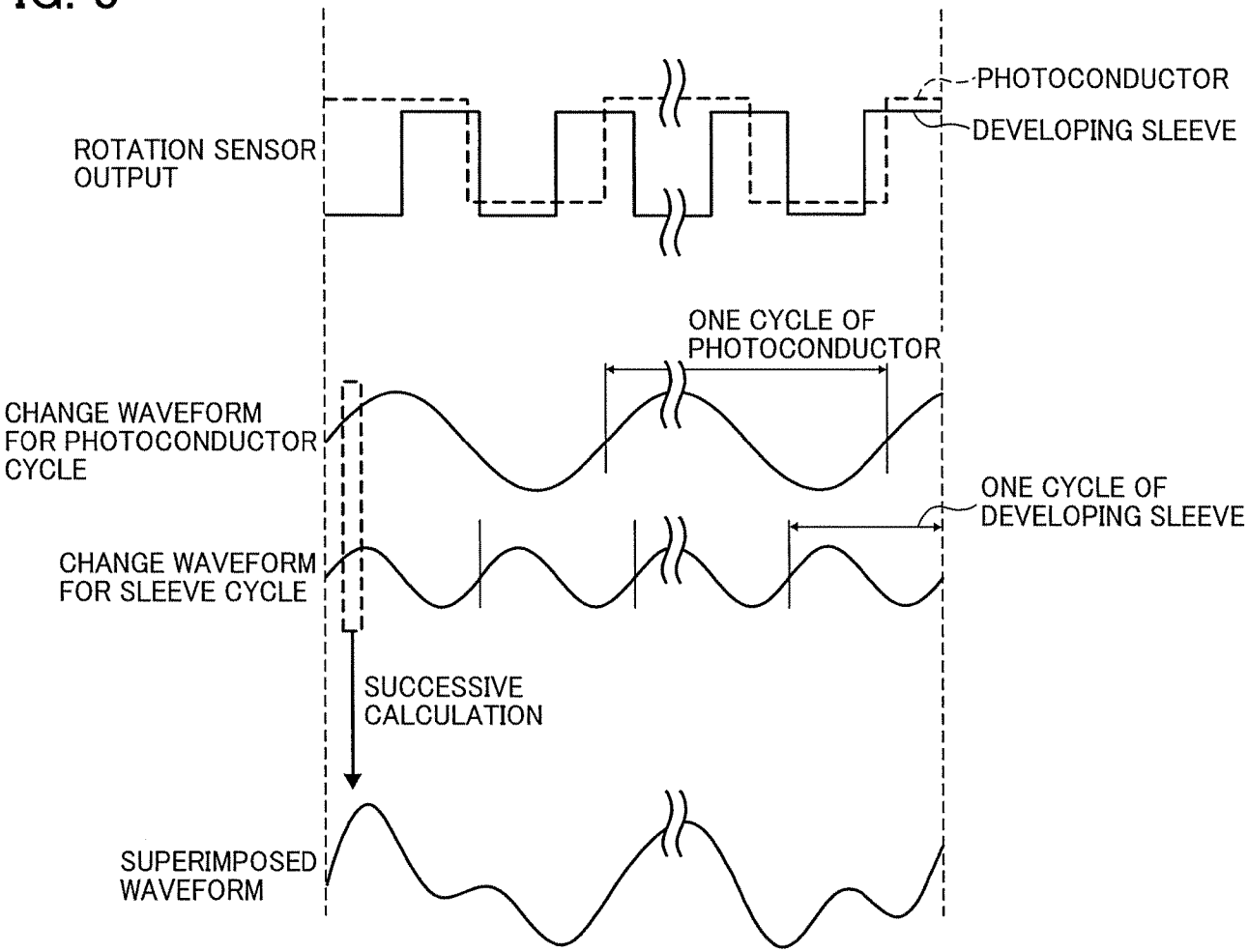
FIG. 8 is a graph illustrating a change over time in various parameters during a print job.

As illustrated in FIG. 8, for each of Y, C, M, and K, data read from the light amount correction pattern data for photoconductor cycle and data read from the light amount correction pattern data for sleeve cycle are added to obtain the superimposed value. Then, the light amount of writing light obtained by superimposing the superimposed value on the reference light amount is output from the laser writing device 21.

Thus, a potential variation in which the following two potential variations are superimposed is caused in the electrostatic latent images of Y, C, M, and K. That is, one of the potential variations is a potential variation that offsets a density variation caused by a gap variation occurring in the photoconductor rotation cycle due to the eccentricity of the rotation axis of the photoconductors 20Y, 20C, 20M, and 20K or distortion of the peripheral surface shape. The other one of the potential variations is a potential variation that offsets a density variation caused by a gap variation occurring in the sleeve rotation cycle due to the eccentricity of the rotation axis of the developing sleeves 81Y, 81C, 81M, and 81K or distortion of the peripheral surface shape. Thus, an image portion with a substantially constant density is formed regardless of the rotational attitude of the photoconductors 20Y, 20C, 20M, and 20K and the rotational attitude of the developing sleeves 81Y, 81C, 81M, and 81K. Consequently, an uneven density occurring in the photoconductor rotation cycle and an uneven density occurring in the sleeve rotation cycle can be suppressed.

Four pieces of light amount correction pattern data for photoconductor cycle and four pieces of light amount correction pattern data for sleeve cycle respectively corresponding to Y, C, M, and K are constructed by executing the construction processing at a predetermined timing. The predetermined timing when the construction processing is executed is, for example, the following timing. That is, the predetermined timing is a timing before a first print job and after shipping from a factory (hereinafter referred to as an initial startup timing). The construction processing is also executed at a timing when mount (including mount for replacement) of the image forming units 18Y, 18C, 18M, and 18K is detected (hereinafter referred to as a mount detection timing). Further, the construction processing is also executed at a timing when the amount of environment variation, which is a difference between the current environment and the environment in which the previous construction processing is executed, exceeds a threshold.

At the initial startup timing and the timing when the amount of environment variation exceeds the threshold, for each of the colors of Y, C, M, and K, the light amount correction pattern data for photoconductor cycle and the light amount correction pattern data for sleeve cycle are constructed as needed. On the other hand, at the mount detection timing, the light amount correction pattern data for photoconductor cycle and the light amount correction pattern data for sleeve cycle are constructed only for the image forming unit, the replacement of which has been detected. To enable the construction of the data, as illustrated in FIG. 7, the unit mount sensors 17Y, 17C, 17M, and 17K that individually detect the replacement of the image forming units 18Y, 18C, 18M, and 18K are provided.

The controller 110 uses the amount of variation in absolute humidity in the environment as the environment variation amount described above. The absolute humidity is calculated based on a temperature detection result from the environment sensor 124 and a relative humidity detection result from the environment sensor 124. During the previous construction processing, the absolute humidity is calculated and stored. After that, the calculation of the absolute humidity based on the temperature and humidity detection results obtained by the environment sensor 124 is periodically executed. When the difference (i.e., the environment variation amount) between the value and the stored value of the absolute humidity exceeds a predetermined threshold, another construction processing is executed.

Figure 9:
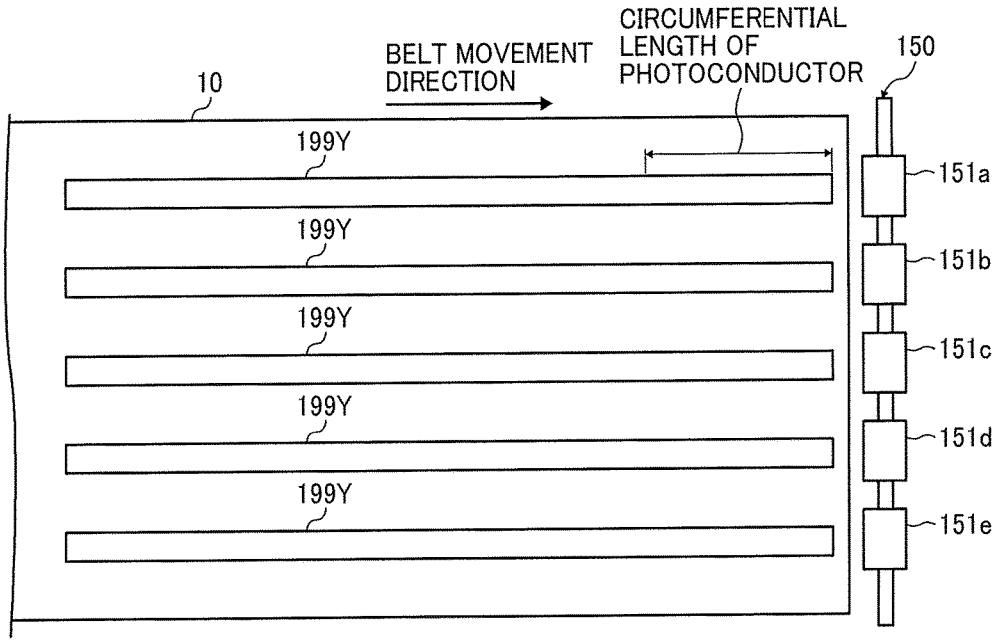
FIG. 9 is a plan view illustrating an intermediate transfer belt and an optical sensor unit in the image forming apparatus.

FIG. 9 is a plan view illustrating the intermediate transfer belt 10 and the optical sensor unit 150. The optical sensor unit 150 disposed so as to be opposed to the outer surface of the loop of the intermediate transfer belt 10 through a gap of 5 mm includes a supporter extending in the width direction of the intermediate transfer belt 10. The optical sensor unit 150 also includes a first reflective optical sensor 151*a*, a second reflective optical sensor 151*b*, a third reflective optical sensor 151*c*, a fourth reflective optical sensor 151*d*, and a fifth reflective optical sensor 151*e*, which are held by the supporter so as to be arranged at a predetermined pitch in the above-mentioned direction. The reflective optical sensors are hereinafter collectively referred to as five reflective optical sensors 151.

On the outer surface of the loop of the intermediate transfer belt 10 illustrated in FIG. 9, five Y-test toner images 199Y (uneven density detection targets) which extend in a belt movement direction and are arranged at a predetermined pitch in a belt width direction are formed with a single image density. These Y-test toner images 199Y pass immediately below any one of the five reflective optical sensors 151 along with the endless movement of the intermediate transfer belt 10. In this case, the image density (toner adhesion amount) is detected by the reflective optical sensor 151.

In the above description, the example in which the image density of the Y-test toner images 199Y is detected by the optical sensor unit 150 is described with reference to FIG. 9. Test toner images for C, M, and K are also detected by the optical sensor unit 150 in the same manner.

Figure 10:
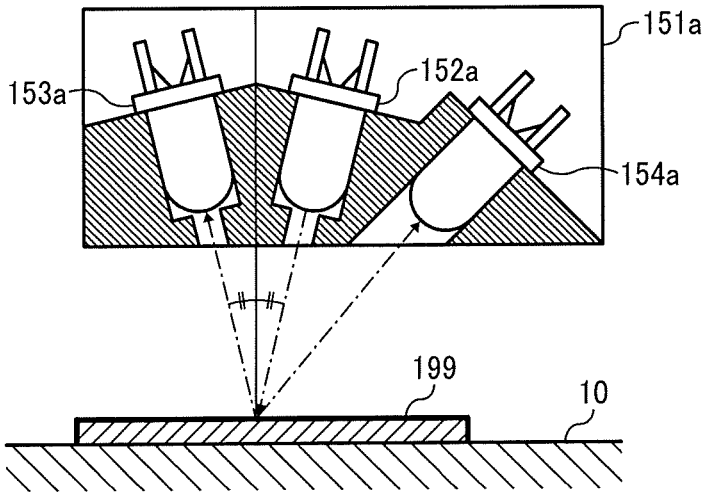
FIG. 10 is an enlarged configuration diagram illustrating a first reflective optical sensor mounted on the optical sensor unit.

FIG. 10 is an enlarged configuration diagram illustrating the first reflective optical sensor 151*a* mounted on the optical sensor unit 150. The first reflective optical sensor 151*a* includes an LED 152*a* serving as a light source, a specular reflective light-receiving element 153*a* that receives specular reflection light, and a diffused reflective light-receiving element 154*a* that receives diffused reflection light. The specular reflective light-receiving element 153*a* outputs a voltage corresponding to the light amount of specular reflection light obtained on the surface of a test toner image 199. The diffused reflective light-receiving element 154*a* outputs a voltage corresponding to the light amount of diffused reflection light obtained on the surface of the test toner image 199. The controller 110 can calculate a toner adhesion amount (image density) of the test toner image 199 based on the voltages.

As the LED 152*a*, for example, a gallium arsenide (GaAs) infrared light-emitting diode that emits light having a peak wavelength of 950 nm is used. As the specular reflective light-receiving element 153*a* and the diffused reflective light-receiving element 154*a*, for example, silicon (Si) phototransistors having a peak light receiving sensitivity of 800 nm are used. However, the peak wavelength and the peak light receiving sensitivity are not limited to the values described above.

While the first reflective optical sensor 151*a* has been described above, the second reflective optical sensor 151*b*, the third reflective optical sensor 151*c*, the fourth reflective optical sensor 151*d*, and the fifth reflective optical sensor 151*e* each have a structure similar to that of the first reflective optical sensor 151*a*. The toner adhesion amount of each of the Y-test toner images 199Y, C-test toner image, and M-test toner image is calculated based on the light amounts of the specular reflection light and diffused reflection light as described above. On the other hand, the toner adhesion amount of the K-test toner image is calculated based only on the light amount of the specular reflection light.

The test toner image which has passed through the position opposed to the optical sensor unit 150 along with the endless movement of the intermediate transfer belt 10 is cleaned from the belt outer surface by a cleaning device.

Construction processing for constructing the light amount correction pattern data for sleeve cycle and the light amount correction pattern data for photoconductor cycle for each of Y, C, M, and K will be described below. In this construction processing, first, as illustrated in FIG. 9, five Y-test toner images 199Y are formed on the intermediate transfer belt 10. In this case, the light amount of writing light is fixed to the reference light amount, instead of varying the light amount. The five Y-test toner images 199Y are formed with a length greater than an integral multiple of the perimeter of the photoconductor 20Y in the belt movement direction. The area gray scale of the test toner images for each color, such as the Y-test toner images 199Y, is a specific value in a range from 10% to 90%. The value may be less than 10%, or more than 90%.

The controller 110 (see FIG. 7) recognizes an uneven density in the belt movement direction based on the output voltages from the first to fifth reflective optical sensors (151*a* to 151*e*) for each of the five Y-test toner images 199Y. A time lag between the start of formation of the test toner image (start of writing of the electrostatic latent image) and the arrival of the leading end of the test toner image at a detection position by the reflective optical sensors of the optical sensor unit 150 is different among the four colors. However, in the case of the same color, the time lag is a substantially constant value (hereinafter referred to as a writing-detection time lag).

The controller 110 preliminarily stores the writing-detection time lag for each color in the nonvolatile memory. After the formation of the Y-test toner image is started, sampling of an output from the reflective optical sensors (151*a* to 151*e*) is started from a point when the writing-detection time lag for yellow (Y) has elapsed. This sampling is repeatedly performed at predetermined intervals. The intervals are identical to the intervals at which data in the light amount correction pattern data used for the light amount variation processing described above is read. After the sampling is finished, the controller 110 constructs a density variation graph indicating the relationship between the toner adhesion amount (image density) and time (or surface movement distance) based on sampling data. The density variation graph is individually constructed for each of the five Y-test toner images.

A position which is located in the width direction on the outer surface of the intermediate transfer belt 10 and at which the toner adhesion amount is detected by the first reflective optical sensor 151*a* (see FIG. 9) is hereinafter referred to as a position "a" (see FIG. 13). Positions at which the toner adhesion amounts are detected by the second reflective optical sensor 151*b*, the third reflective optical sensor 151*c*, the fourth reflective optical sensor 151*d*, and the fifth reflective optical sensor 151*e* (see FIG. 9), respectively, are referred to as a position "b", a position "c", a position "d", and a position "e" (see FIG. 13), respectively. The width direction on the outer surface of the intermediate transfer belt 10 is identical to the rotation axis direction (orthogonal direction orthogonal to the surface movement direction on the surface of the photoconductor. Accordingly, also for positions in the rotation axis direction on the surface of the photoconductor, the same positions as those described above are referred to as the position "a", the position "b", the position "c", the position "d", and the position "e".

The method for analyzing the density variation pattern of the Y-test toner image for each of the position "a", the position "b", the position "c", the position "d", and the position "e" has been described above. Also, for C, M, and K, the density variation pattern at each position is sequentially analyzed in the same manner as the method for Y.

Figure 11:
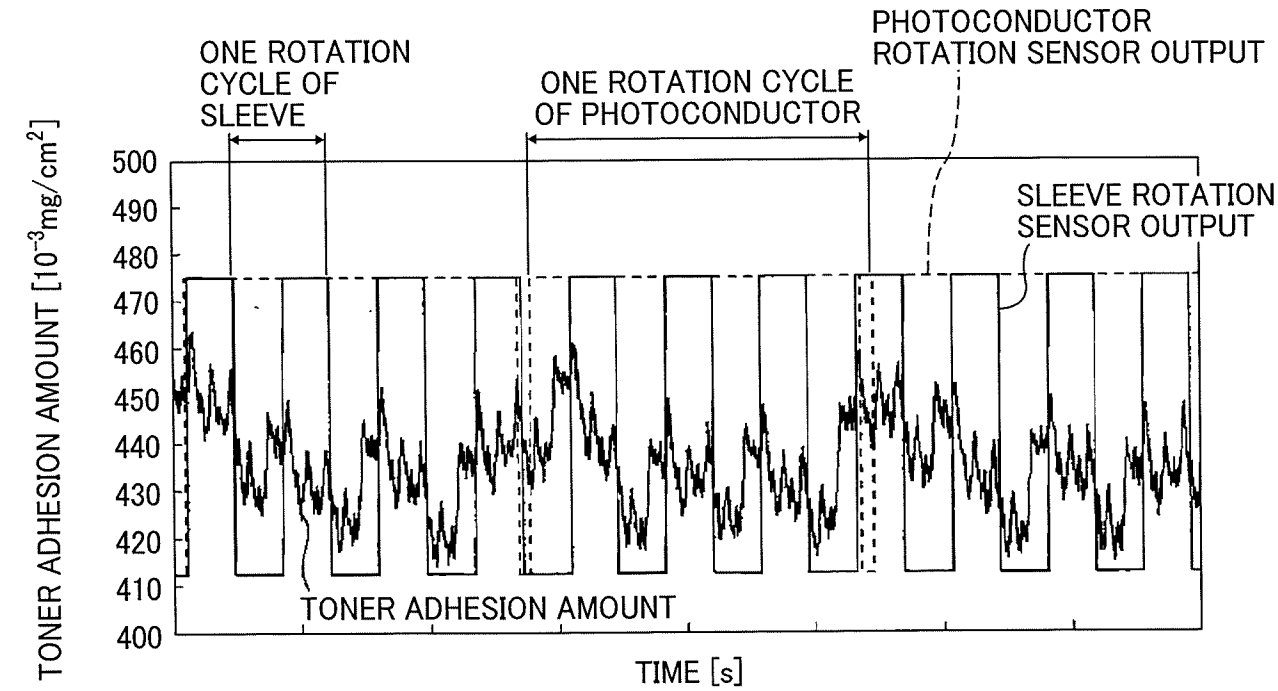
FIG. 11 is a graph illustrating a relationship between a density variation pattern for a Y test toner image, a sleeve rotation sensor output, and a photoconductor rotation sensor output.

FIG. 11 is a graph illustrating a density variation (pattern of periodic variation of the toner adhesion amount) of the Y-test toner image, and also illustrating the relationship between a sleeve rotation sensor output and a photoconductor rotation sensor output. In the density variation graph illustrated in FIG. 11, the density variation is detected, for example, at the position "a" illustrated in FIG. 13, and a density variation pattern occurring in the developing sleeve rotation cycle and a density variation pattern occurring in the photoconductor rotation cycle are superimposed.

The controller 110 individually extracts two types of partial graphs from the density variation graph for each of the five positions ("a" to "e") for Y. A first graph is a partial graph for each sleeve rotation cycle. A second graph is a partial graph for each photoconductor rotation cycle. As for the partial graph for each sleeve rotation cycle, a partial graph having a length corresponding to one cycle of sleeve rotation is extracted for each revolution based on the reference attitude timing of the developing sleeve 81Y for yellow (Y). As for the partial graph for each photoconductor rotation cycle, a partial graph having a length corresponding to one cycle of photoconductor rotation is extracted for each revolution based on the reference attitude timing of the photoconductor 20Y for yellow (Y). Since the sleeve rotation cycle is shorter than the photoconductor rotation cycle, the number of partial graphs for each sleeve rotation cycle extracted from the density variation graph corresponding to one Y-test toner image is greater than the number of partial graphs for each photoconductor rotation cycle.

Figure 12:
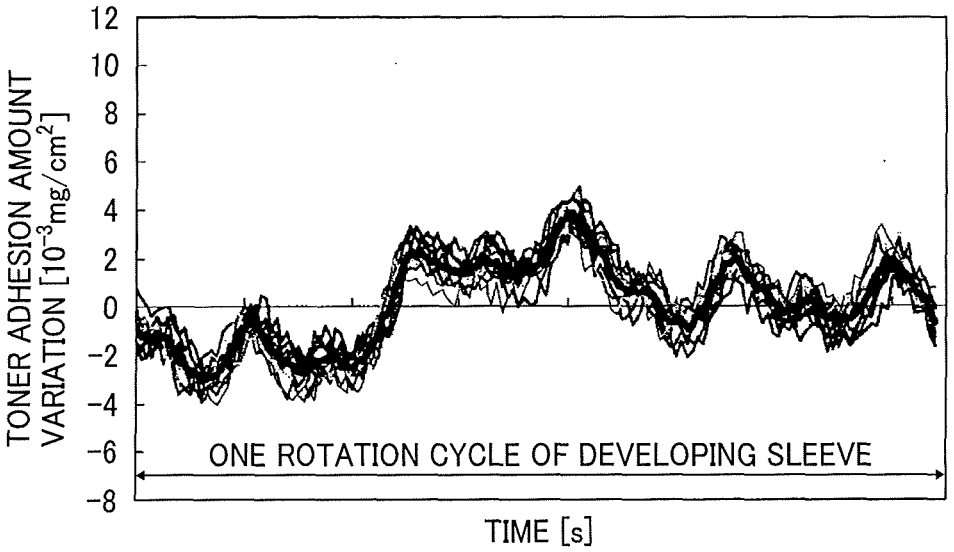
FIG. 12 is a graph illustrating an average waveform of a periodic variation waveform in a sleeve rotation cycle.

After the extraction of the partial graphs is finished, the controller 110 obtains, for each of the five positions ("a" to "e"), an average waveform of a plurality of extracted partial graphs for each sleeve rotation cycle and an average waveform of a plurality of extracted partial graphs for each photoconductor rotation cycle. Specifically, first, an average value within a cycle is obtained for each of the plurality of extracted partial graphs for each sleeve rotation cycle. Further, the partial graphs in a plurality of sleeve rotation cycles are superimpose as illustrated in FIG. 12 based on the average values. Then, at each point within a cycle, an average value of the values in each partial graph is obtained and an average waveform following the average values (a waveform indicated by a thick line in FIG. 12) are obtained. When each point within one cycle is focused, there is a variation in values in each graph, and the variation is caused due to a difference between values of the variation elements in another cycle for each revolution. However, the variation elements in another cycle can be eliminated by averaging.

Next, the controller 110 analyzes the frequency of the average waveform described above by Fourier transform (FFT), quadrature detection, or the like to thereby obtain an average waveform formula. For example, the average waveform formula represented by superimposing a plurality of since waveforms in the following formula by frequency analysis using quadrature detection is obtained. This average waveform formula is used as a density variation pattern occurring in the sleeve rotation cycle.

$$f(t) = A1 \times \sin(\omega t + \theta 1) + A2 \times \sin(2 * \omega t + \theta 2) + A3 \times \sin(3 * \omega t + \theta 3) + \ldots + A20 \times \sin(i * \omega t + \theta 20)$$

In this formula, f(t) represents an uneven density average waveform [$10^{-3}$ mg/cm$^2$]. Ai is the density value (amplitude at θi) [$10^{-3}$ mg/cm$^2$]. ω is the angular velocity [rad/s] of the developing sleeve 81Y. θi is the phase [rad] within the cycle.

The above-mentioned formula can be converted into the following formula.

$$f(t) = \Sigma Ai \times \sin(i \times \omega t + \theta i)$$

where i=1 to 20.

Figure 13:
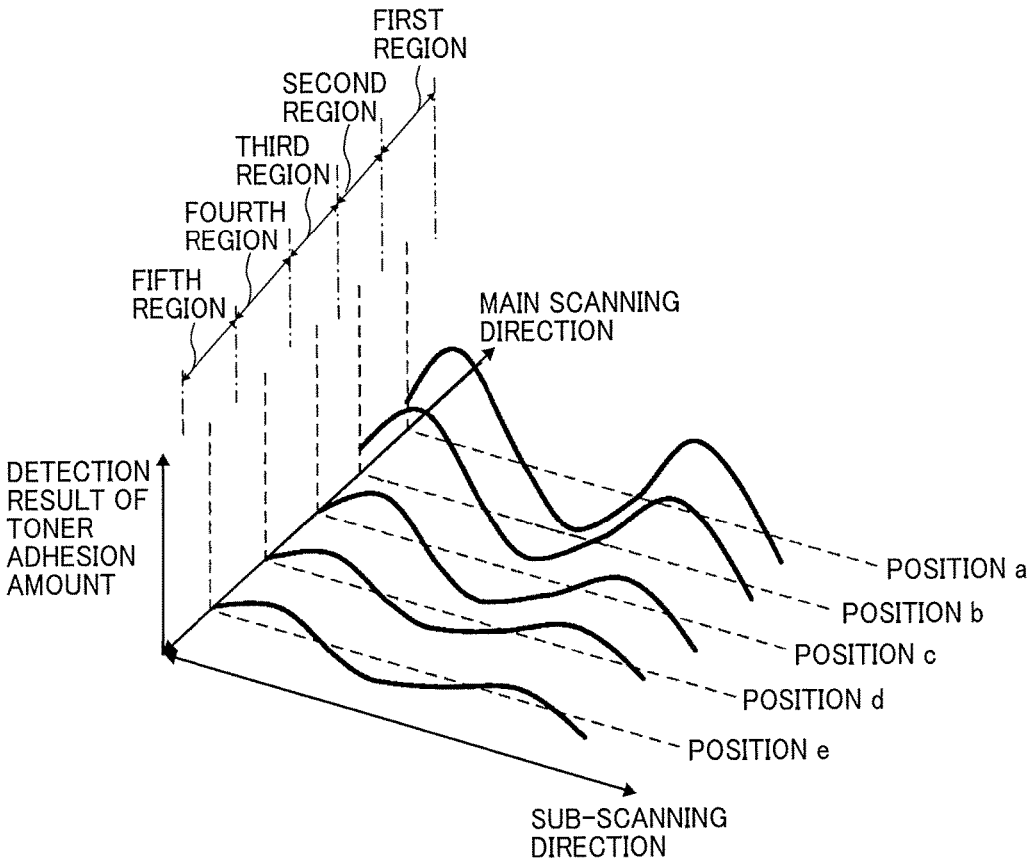
FIG. 13 is a three-dimensional graph illustrating a density (toner adhesion amount) variation pattern in the sleeve rotation cycle at positions (a to e)

FIG. 13 is a three-dimensional graph illustrating a density (toner adhesion amount) variation pattern in a sleeve rotation cycle at each position ("a" to "e"). In FIG. 13, a main-scanning direction is identical to a photoconductor axis direction (i.e., optical scanning direction). A sub-scanning direction is identical to a photoconductor surface movement direction. As illustrated in FIG. 13, the shape of the density variation pattern at each position has a variation. This is caused due to a slight inclination or the like from the horizontal direction of the photoconductor rotation axis.

The method for obtaining the formula for the density variation pattern occurring in the sleeve rotation cycle has been described above. Also, the formula for the density variation pattern occurring in the photoconductor rotation cycle is obtained for each of the five positions ("a" to "e") by a method similar to the method for the sleeve rotation cycle.

The controller 110 (see FIG. 7) obtains the formula for the density variation pattern in the sleeve rotation cycle for each of the five positions ("a" to "e"), and then constructs light amount correction pattern data for sleeve rotation cycle to offset the density variation pattern in the sleeve rotation cycle. Specifically, based on the formula for the density variation pattern in the sleeve rotation cycle, the controller 110 calculates the light amount differences corresponding to the individual toner adhesion amounts at each point in the sleeve rotation cycle. In this case, the light amount difference corresponding to the toner adhesion amount having the same value as that of a target adhesion amount is calculated as zero. The light amount difference corresponding to the toner adhesion amount greater than the target adhesion amount is calculated as the value of a negative polarity corresponding to the difference between the toner adhesion amount and the target adhesion amount. Since the light amount difference is calculated as the value of a negative polarity, the value is used to decrease the amount of writing light after superimposition to be smaller than the amount of reference light. The light amount difference corresponding to the toner adhesion amount smaller than the target adhesion amount is calculated as the value of a positive polarity corresponding to the difference between the toner adhesion amount and the target adhesion amount. Since the light amount difference is calculated as the value of a positive polarity, the value is used to increase the amount of writing light obtained after superimposing to be greater than the reference light amount. In this manner, the light amount differences at each point are obtained and the pieces of data arranged in order are constructed as the light amount correction pattern data for sleeve cycle.

Next, the controller 110 (see FIG. 7) obtains the formula for the density variation pattern in the photoconductor rotation cycle for each of the five positions ("a" to "e"), and then constructs the light amount correction pattern data for photoconductor cycle to offset the density variation pattern in the photoconductor rotation cycle based on the formula. A specific data construction method is similar to the method for constructing the light amount correction pattern data for sleeve cycle.

As described above, the light amount correction pattern data for sleeve cycle and the light amount correction pattern data for photoconductor cycle corresponding to each of the five positions ("a" to "e") are constructed for each of Y, C, M, and K, and then the construction processing is terminated.

The surface of each of the photoconductors 20Y, 20C, 20M, and 20K in the rotation axis direction is divided into five areas (surface positions). A first area is an area that includes the position "a" illustrated in FIG. 13 and is located on the other end side in the rotation axis direction. A second area is an area that includes the position "b" and is adjacent to the first area. A third area is an area that includes the position "c" and is adjacent to the second area. A fourth area is an area that includes the position "d" and is adjacent to the third area. A fifth area is an area that includes the position "e" and is adjacent to the fourth area.

In the case of executing a print job based on an instruction from a user, the controller 110 (see FIG. 7) adjusts the amount of writing light for the electrostatic latent image on the photoconductors 20Y, 20C, 20M, and 20K for yellow (Y), cyan (C), magenta (M), and black (K) as follows. That is, in the case of optically writing data into the first area, the amount of writing light is adjusted based on the light amount correction pattern data for sleeve cycle at the position "a" and the light amount correction pattern data for photoconductor cycle at the position "a". Specifically, the superimposed light amount obtained based on the pieces of light amount correction pattern data is superimposed on a predetermined reference light amount. The superimposed light amount is obtained by adding a light amount value specified from the light amount correction pattern data for sleeve cycle and a light amount value specified from the light amount correction pattern data for photoconductor cycle as indicated by a dashed frame in FIG. 8 (superimposed waveform value). When the value of the superimposed light amount indicates a negative polarity, optical writing of the electrostatic latent image is performed with a writing light amount less than the reference light amount. When the value of the superimposed light amount indicates a positive polarity, optical writing of the electrostatic latent image is performed with a writing light amount more than the reference light amount. In the superimposed waveform illustrated in FIG. 8, a peak value on the mountain side indicates a positive polarity, while a peak value on the valley side indicates a negative polarity.

The adjustment of the writing light amount for the first area has been described above. Similarly, the writing light amount for the second area, the third area, the fourth area, and the fifth area is also adjusted. Thus, in each area, the occurrence of an uneven density in the sleeve rotation cycle, or the occurrence of an uneven density in the photoconductor rotation cycle can be suppressed by adjusting the writing light amount. In this manner, in the subsequent print job, a variation in amplitude within a cycle, i.e., a so-called periodic variation, is caused by correcting the writing intensity of a latent image by an optical scanning device based on the variation pattern data. Thus, when the photoconductor or the developing roller do not have a true circular shape, a periodic density variation (uneven density) of an image due to a periodic variation of the gap between the photoconductor and the developing roller can be suppressed. However, if there is a measurement error in the density detection value of the toner image detected by the optical sensor unit 150 (see FIG. 9), an actual uneven density in the variation pattern data constructed based on the detection value cannot be suppressed, which leads to a deterioration in the variation pattern image.

Figure 14:
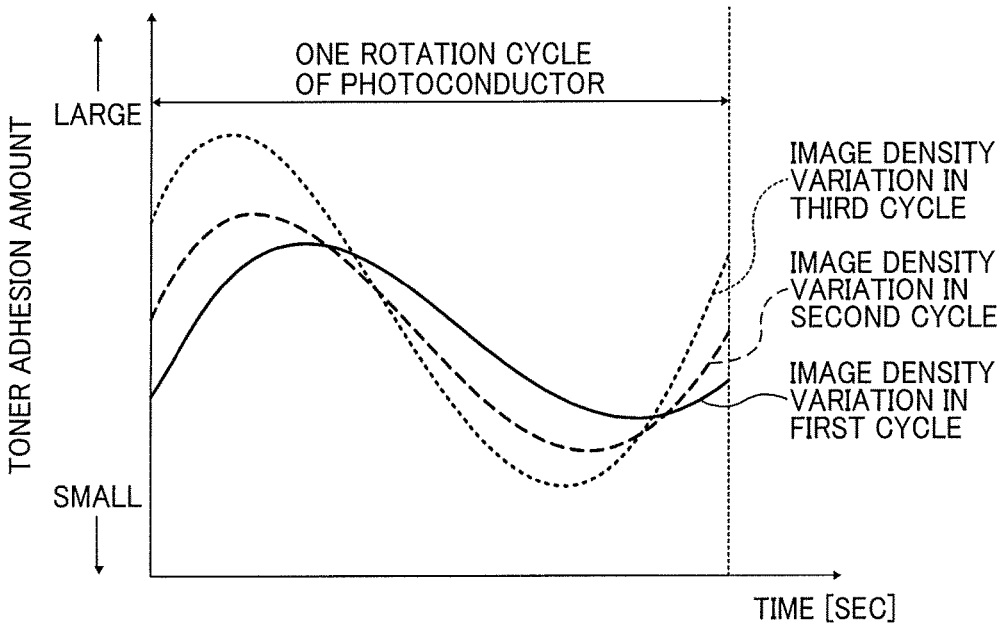
FIG. 14 is a graph illustrating a measurement error in a toner adhesion amount.

The density variation pattern of the test toner image includes a measurement error based on various factors. If there is a measurement error, as illustrated in a schematic diagram of FIG. 14, a mismatch occurs in the phase or amplitude of the density variation pattern in each revolution in which the cycles of the photoconductors are matched based on the rotation sensor reference. FIG. 14 illustrates the density variation pattern in the photoconductor cycle. The density variation pattern in the sleeve cycle also includes a measurement error. If a periodic variation of the writing light amount is caused according to the light amount correction pattern data constructed based on the detection result including relatively large measurement errors, the uneven density becomes worse.

In the construction processing described above, the quality of the density variation pattern for each position ("a" to "e") is individually determined. Light amount correction pattern data is not constructed based on the detection result of the density variation data at a faulty position where the determination result indicates fail. Thus, a deterioration in the uneven density can be avoided.

The quality of the density variation pattern is determined based on a variation in the value at each point within one cycle (photoconductor cycle). For example, as illustrated in FIG. 14, assume that a density variation pattern corresponding to three turns of the photoconductor is detected. In this case, quadrature detection is performed for each revolution to obtain an amplitude $A_1$, an amplitude $A_2$, and an amplitude $A_3$ of a first round, a second round, and a third round, respectively, and a phase $\theta_1$, a phase $\theta_2$, and a phase $\theta_3$, and then obtain a variation $\sigma_1$ in the amplitudes $A_1$ to $A_3$ and a variation $\sigma_2$ in the phases $\theta_1$ to $\theta_3$. When one of the variations is smaller than the threshold value, it is determined to be "good", while if it is equal to or larger than the threshold value, it is determined as "fail".

The phase $\theta$ described herein refers to each point within one cycle, and the phases $\theta_1$ to $\theta_3$ are the same point in the time axis of FIG. 14. The phases $\theta_1$, $\theta_2$, $\theta_3$, . . . within the first round, the second round, the third round, . . . , respectively, are present at the points 1, 2, 3, respectively within one cycle.

An amplitude A it not the difference between a maximum value or a minimum value and a center value within one cycle, but is the difference between the detection result and a target adhesion amount at each point on the time axis in FIG. 14. Each of the amplitude $A_1$, the amplitude $A_2$, the amplitude $A_3$, . . . is the difference at the same point within one cycle.

Regarding the variation of the phase $\theta$, for example, a method for calculating each phase difference ($|\theta_1-\theta_2|$, $|\theta_1-\theta_3|$, $|\theta_2-\theta_3|$, . . . ) and setting the maximum value as the variation $\sigma_2$ can be employed. In addition, the variation $\sigma_2$ may be obtained using a deviation from the average value of phase information, a standard deviation, or the like. The same holds true for the variation $\sigma_1$ of the amplitude A.

The quality determination method is not limited to a method based on a variation. For example, the quality determination may be made based on the presence or absence of a failure (output abnormality) in the reflective optical sensors (151*a* to 151*e*), a local abnormality (extremely thin or extremely thick) in the density pattern, a variation in the amplitude, or the like. If the detection result from a certain reflective optical sensor indicates an extremely low or high value, it is suspected that a failure has occurred in the sensor. If the toner adhesion amount of a certain test toner image of a plurality of test toner images is extremely high or low, it is suspected that a local toner shortage in the developing device has occurred.

While the density variation pattern in the photoconductor cycle has been described above, the quality of the density variation pattern in the sleeve cycle is also determined in a manner similar to that for the density variation pattern in the photoconductor cycle.

Figure 15:
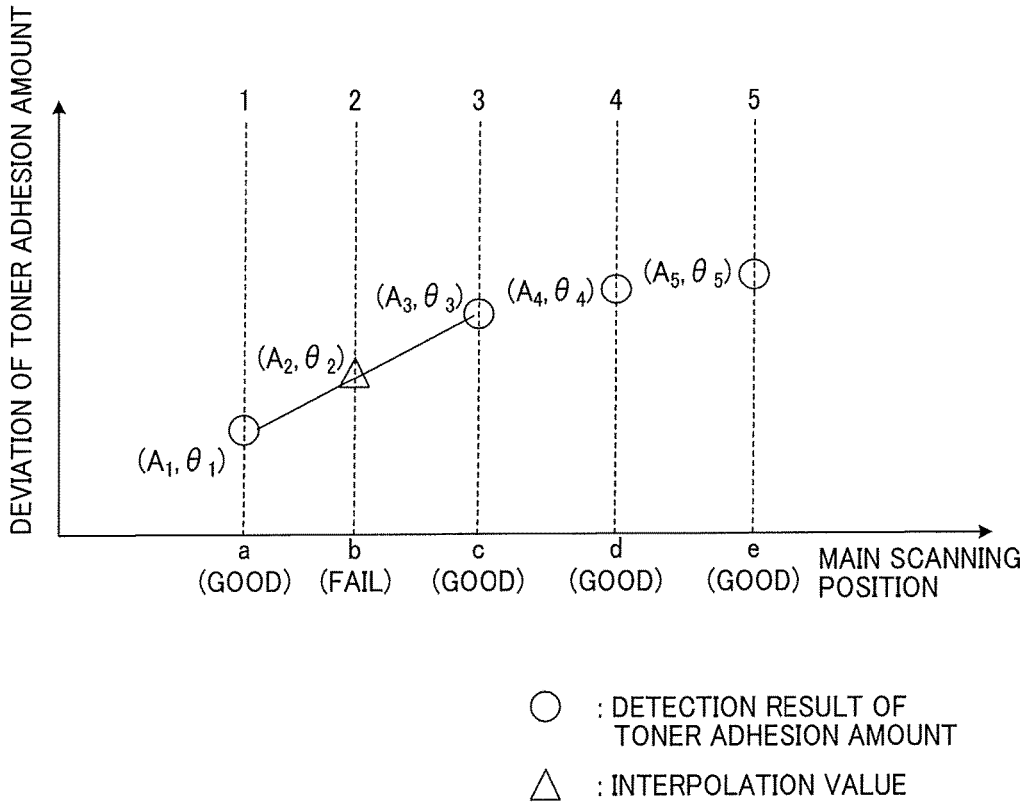
FIG. 15 is a graph illustrating a first example of data interpolation in construction processing.

As for the writing light amount at a faulty position, the reference light amount may be maintained constant without causing a periodic variation in the light amount correction pattern data. However, in order to further reduce an uneven density in the image forming apparatus, the following periodic variation is executed. Specifically, if the determination result as to whether the detection result of the quality determination indicates pass or fail indicates "fail", the periodic variation in the light amount correction pattern data constructed by another method is executed, instead of executing the periodic variation in the light amount correction pattern data constructed based on the density variation pattern detected at a faulty position. For example, as illustrated in FIG. 15, a case where the determination result indicates that the variation in the toner adhesion amount of the density variation pattern at the five positions ("a" to "e") is "good" at the position "a", the position "c", the position "d", and the position "e", and the variation in the toner adhesion amount of the density variation pattern only at the position "b" is "fail" will be described. Specifically, if positions adjacent to a position where the determination result indicates "fail" are determined to be "good", a deviation at the position "b" is interpolated with a deviation at the position "a" adjacent to the position "b" and a deviation at the position "c". The interpolation of deviations is performed at each point (each point in the sub-scanning direction in FIG. 5) of the density variation pattern, and a deviation (density deviation) at the position "b" is interpolated with density variation pattern data. Data thus obtained is set as the density variation pattern data at the position "b". The term "deviation" described herein refers to a deviation from a target toner adhesion amount.

A specific interpolation method will be described. When the positions (position "a" and position "c") adjacent to a faulty position where the determination result indicates "fail" are excellent positions ("good") as illustrated in FIG. 15, a method for linearly interpolating the detection results on both sides is used. In this method, the reflective optical sensors (151*a* to 151*e*) are arranged at regular intervals. When the amplitudes A on both sides are $A_1$ and $A_3$ and the phases are $\theta_1$ and $\theta_3$, the interpolation value of the amplitude $A_2$ and the phase $\theta_2$ at the position "b", which is a faulty position, can be obtained by the following formula.

$$A_2=\sqrt{\alpha^2+\beta^2}$$

$$\theta_2=\arctan(\beta/\alpha) \qquad \text{Formula 1}$$

where $$\alpha=A_1\times\cos(\theta_1)+A_3\times\cos(\theta_3)$$

$$\beta=A_1\times\sin(\theta_1)+A_3\times\sin(\theta_3)$$

Figure 16:
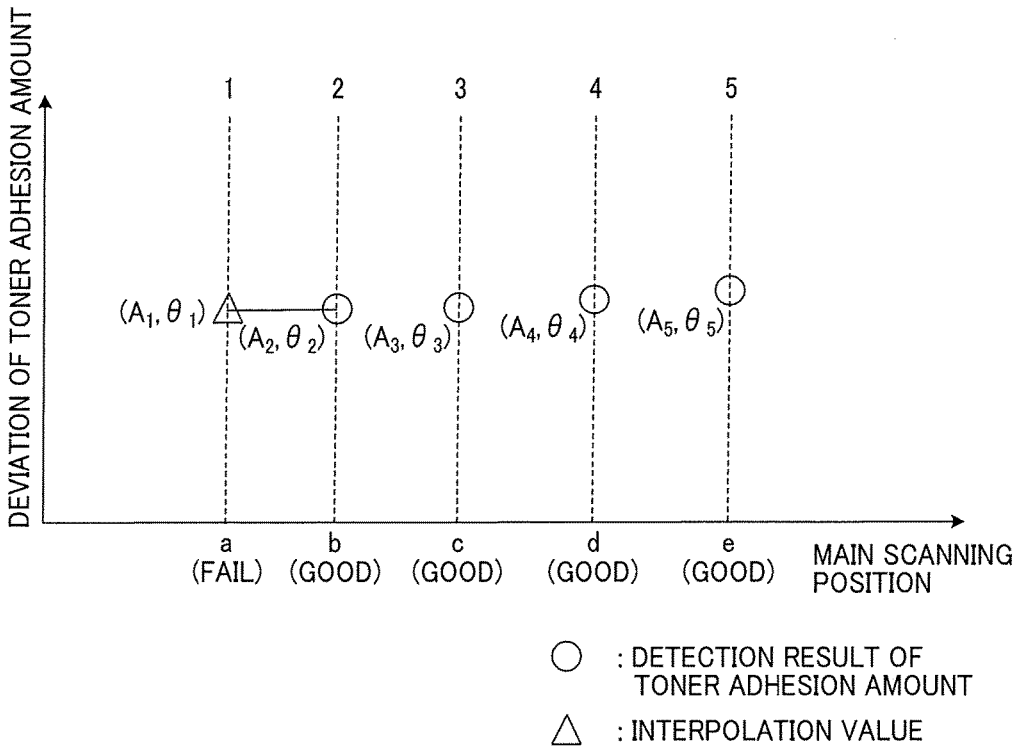
FIG. 16 is a graph illustrating a second example of data interpolation in the construction processing.

On the other hand, as illustrated in FIG. 16, the position "a" at an end indicates "fail", which indicates a faulty position, the amplitude $A_1$ and the phase $\theta_1$ at the position "a" are interpolated based on the amplitude $A_2$ and the phase $\theta_2$ at the position "b" which is an excellent position adjacent to the position at one end. As a specific interpolation method, the same value as that indicated by the detection result for the adjacent position is set as indicated by the following formula.

$$A_1=A_3$$

$$\theta_1=\theta_2 \qquad \text{Formula 2}$$

Instead of using the method for setting the same value, the interpolation value may be obtained by a linear approximation formula from two-dimensional coordinates of a detection result and a distance in an excellent position group composed of a plurality of continuous excellent positions including the adjacent excellent positions. Although the case where the position "a" at an end is a faulty position has been described above, the interpolation value at the position "e" at an end can also be obtained by the same method.

Figure 17A:
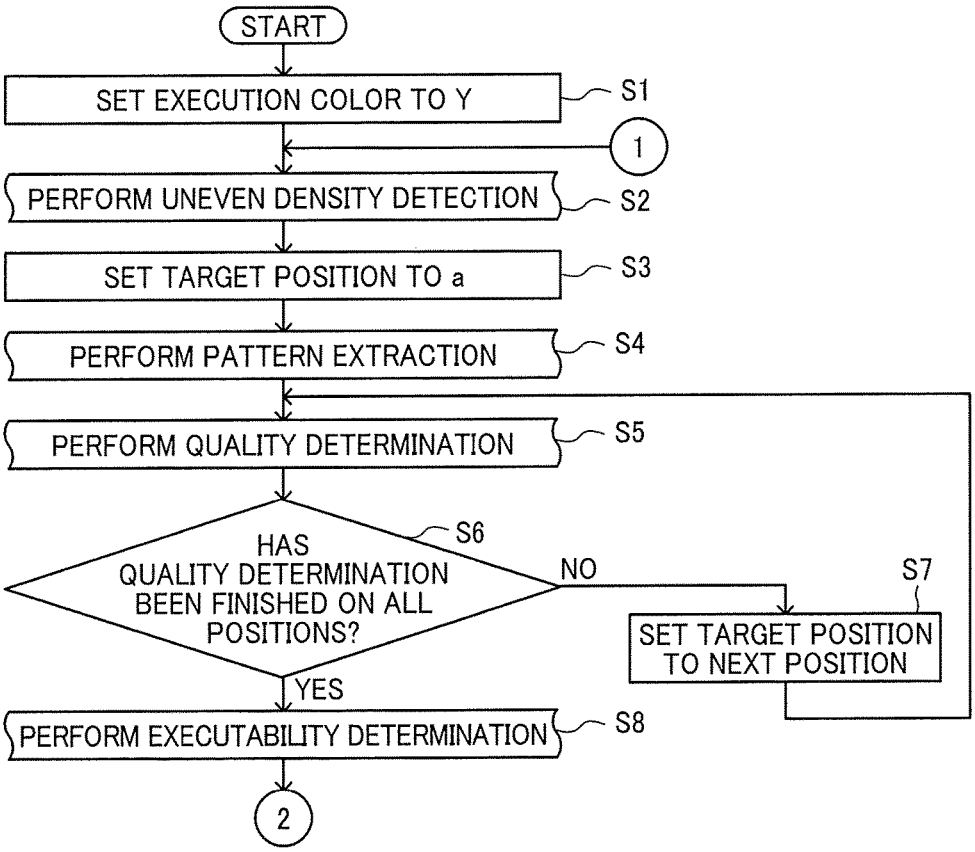
FIGS. 17A and 17B is a flowchart illustrating a processing flow of construction processing performed by a controller of the image forming apparatus.
Figure 17B:
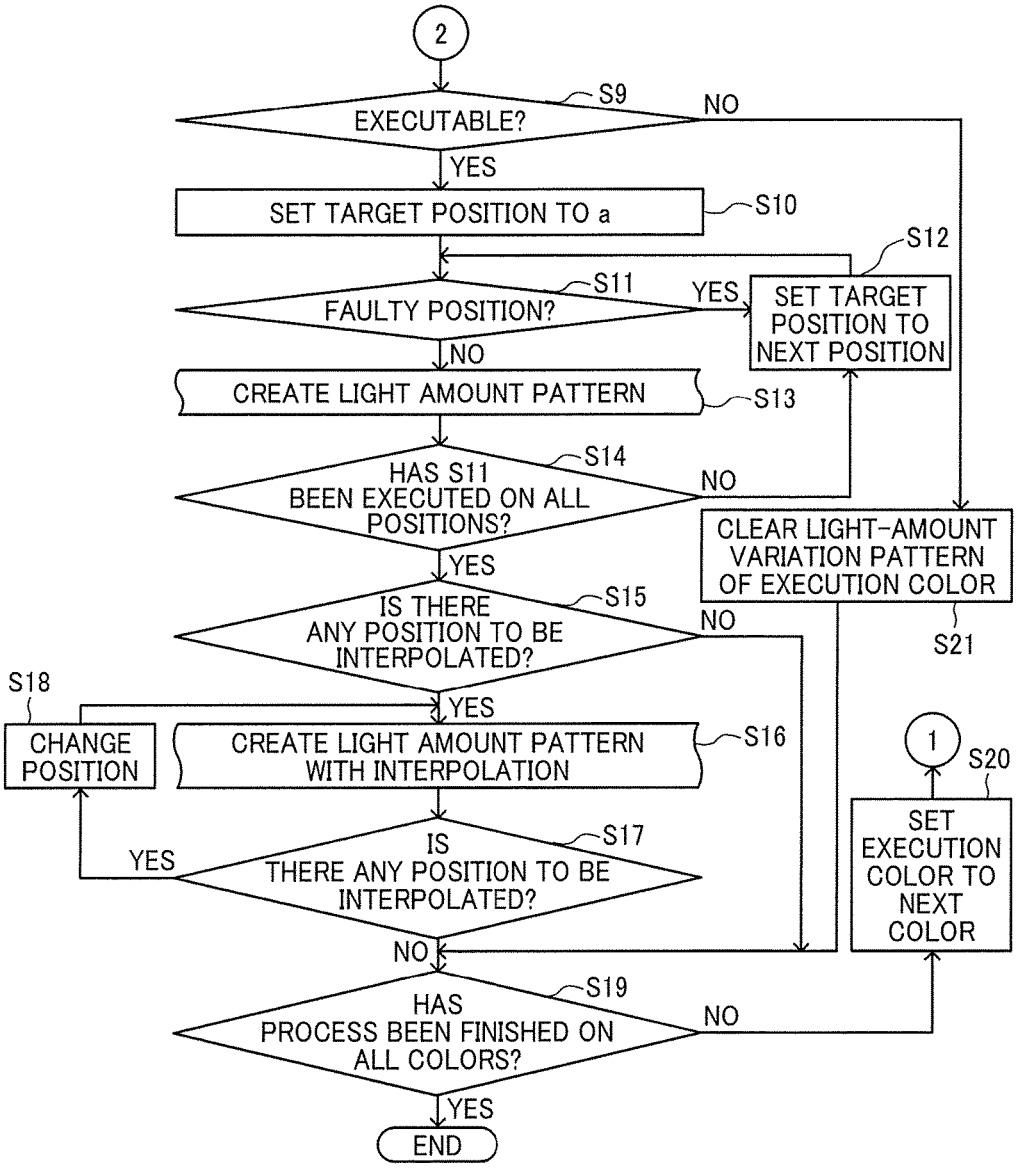

A method for avoiding an uneven density based on the quality of the density variation pattern detected by the reflective optical sensor will be described using the structure of the image forming apparatus according to the present embodiment. FIG. 17 is a flowchart illustrating each process of the construction processing executed by the controller 110 (see FIG. 7). When the construction processing is started, first, an execution color is set as an initial value for yellow (Y) (step 1; a step is hereinafter abbreviated as "S").

After the execution color is set, uneven density detection processing is executed (S2). In the uneven density detection processing, test toner images of five execution colors are formed on the intermediate transfer belt 10 (see FIG. 9) and the densities of the test toner images are detected by the reflective optical sensor (151*a* to 151*e* in FIG. 9). After that, a position (a target position in FIG. 17) where pattern extraction processing is executed among the positions "a" to "e" (see FIG. 13) is initially set as the position "a" (S3), and pattern extraction processing for each cycle is executed (S4). In the pattern extraction processing (S4), the density variation pattern in the sleeve rotation cycle and the density variation pattern in the photoconductor rotation cycle are extracted from the periodic variation pattern (FIG. 11) in the detected toner adhesion amount of the test toner image, and the results are stored in the nonvolatile memory.

When the density variation patterns are extracted, the quality of the density variation pattern in the sleeve rotation cycle at the position "a" is determined. Further, it is determined whether the density variation pattern in the photoconductor rotation cycle is pass or fail (S5). When one of the two determinations indicates "fail", the determination result as to the quality of the detection value at the position "a" indicates "fail". When both the two determinations indicate "fail", the determination result as to the quality of the detection value at the position "a" may indicate "fail". After the quality determination processing is performed, it is determined whether the quality determination at all positions ("a" to "e") has been made (S6). If there is a position where the quality determination has not been made (NO in S6), the target position is set as the next position (in the order from the position "a" where the processing is started to the position "e") (S7), and then steps S4 to S6 are executed for the next position.

If the quality determination at all positions has been made (YES in S6), executability determination processing is executed (S8). In the executability determination processing (S8), it is determined whether or not to execute light amount variation processing during a print job after the end of each step of the construction processing.

Figure 18:
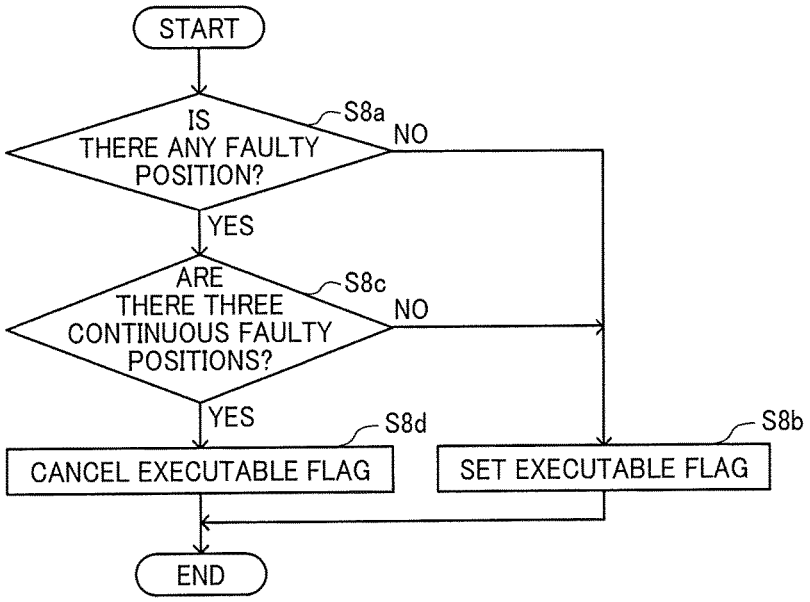
FIG. 18 is a flowchart illustrating a detailed processing flow of executability determination processing (S8) performed in FIG. 17.

FIG. 18 is a flowchart illustrating a detailed processing flow of the executability determination processing (S8) executed in FIG. 17. In the executability determination processing, it is determined whether there is a position determined to be a faulty position among the positions ("a" to "e") arranged at regular intervals such as five intervals (S8*a*). If there is no faulty position (the number of faulty positions is zero) (NO in S8*a*), an executable flag indicating the possibility of execution is set (S8*b*), and then the processing flow is terminated. On the other hand, if there is a faulty position (YES in S8*a*), it is determined whether three or more continuous faulty positions are present in the main-scanning direction (S8*c*). If three or more continuous faulty positions are not present (one or two faulty positions are present) (NO in S8*c*), data interpolation with a high degree of accuracy can be performed. Accordingly, after the executable flag is set (S8*b*), the processing flow is terminated. On the other hand, if three or more continuous faulty positions are present (three, four, or five faulty positions are present) (YES in S8*c*), it is difficult to perform data interpolation with a high accuracy. Accordingly, after the executable flag is reset (S8*d*), the processing flow is terminated.

Figure 19:
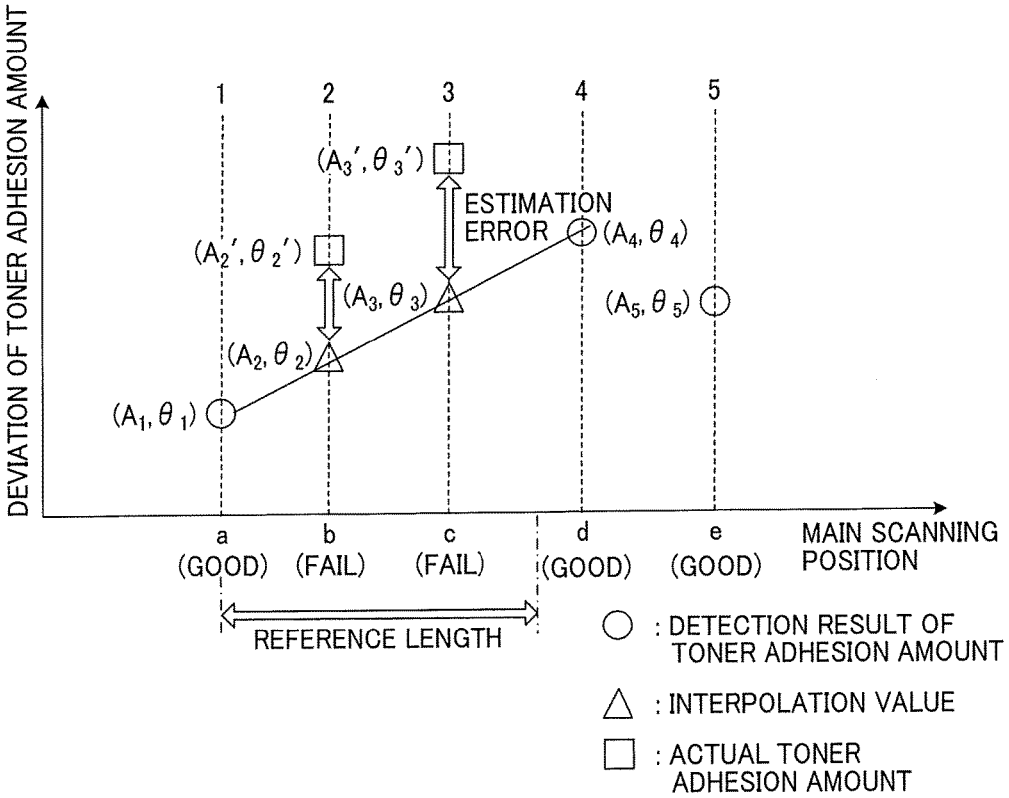
FIG. 19 is a graph illustrating another first example of a determination method in the executability determination processing.
Figure 20:
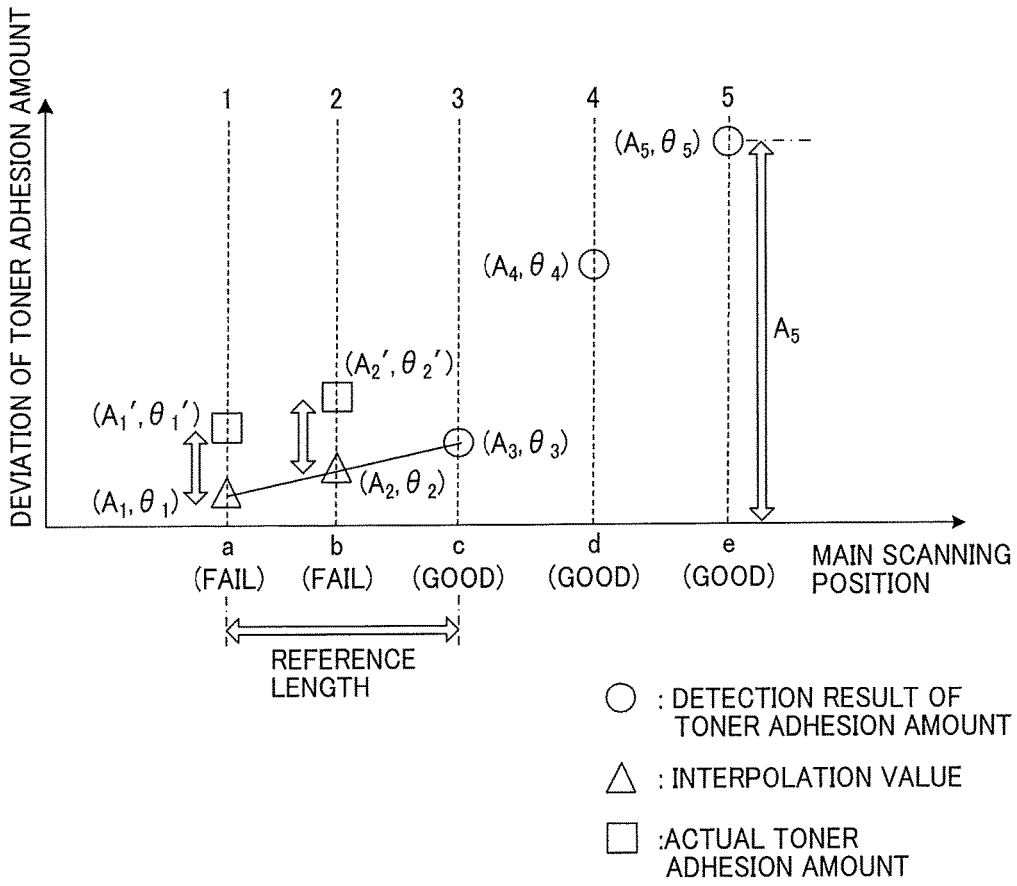
FIG. 20 is a graph illustrating another second example of the determination method in the executability determination processing.

While the example where the execution flag is set (S8*b*) if three or more continuous faulty positions are not present (one or two faulty positions are present) has been described above, the set value may be one or three or more. When the plurality of reflective optical sensors (151*a* to 151*e*) is not arranged at regular intervals, the allowable number of continuous faulty positions may be changed depending on the position in the main-scanning direction. For example, a reference length may be set in advance and the allowable number of continuous faulty positions may be set under the condition that the number is equal to or less than the reference length. Specifically, as illustrated in FIG. 19, in the aspect in which a faulty position is sandwiched between two excellent positions, the allowable number of continuous faulty positions is set based on the comparison between the distance between the two excellent positions and the reference length. In the illustrated example, the distance between the two excellent positions is the distance between the position "a" and the position "d". However, the distance is longer than the reference length. Accordingly, as illustrated in FIG. 19, when two faulty positions (position "b" and position "c") are continuous between the position "a" and the position "d", it is difficult to perform data interpolation with a high accuracy, and thus the execution flag may be reset (S8*d* in FIG. 18). When a faulty position is an end position, or when another faulty position is continuous to the end position, the allowable number of continuous faulty positions is set based on the comparison between the distance between the end position and the excellent positions sandwiching the faulty position and the reference length. For example, as illustrated in FIG. 20, assume that the end position "a" and the position "b" adjacent to the position "a" are faulty positions and the position "c" is an excellent position. As illustrated in FIG. 20, the distance between the position "a", which is an end faulty position, and the position "c", which is an excellent position, is less than the reference length. Accordingly, the allowable number of continuous faulty positions in this case is set to two. If the number of continuous faulty positions is equal to or less than two, the execution flag is set (S8*b* in FIG. 18).

Thus, when the executability determination processing (S8) illustrated in FIG. 17, the detailed processing flow of which is illustrated in FIG. 18, is finished, it is determined whether the light amount variation processing can be executed, that is, it is determined whether the executable flag is set (S9). If the processing cannot be executed (NO in S9), the light amount correction pattern data for sleeve cycle at the position "a" to the position "e" for the execution color yellow (Y) stored in the nonvolatile memory, and the light amount correction pattern data for photoconductor cycle are cleared or initialized (S21), and then a series of construction processing is terminated. Thus, the light amount correction pattern data is not constructed in the light amount pattern construction processing (S13) to be described below for the execution color yellow (Y), and in the execution of the subsequent print job, the light amount of writing light using the light amount correction pattern data is prevented from being varied.

On the other hand, if the light amount variation processing can be executed (YES in S9), the target position is initially set to the position "a" (S10), and then it is determined whether the target position is a faulty position (S11). If the position "a" is a faulty position (YES in S11), the light amount correction pattern data cannot be constructed based on the density variation pattern. Accordingly, the target position is set to the next position (S12), and then the processing flow returns to S11.

If the position "a", which is the target position, is not a faulty position (NO in S11), light amount pattern construction processing is executed (S13). In the light amount pattern construction processing, the light amount correction pattern data for sleeve cycle is constructed based on the density variation pattern data for sleeve rotation cycle, and the light amount correction pattern data for photoconductor cycle is constructed based on the density variation pattern data in the photoconductor rotation cycle.

When the light amount correction pattern data for two cycles are constructed, it is determined whether the step S11 has been executed at all the positions "a" to "e" (S14). If the step S11 has not been executed at all the positions (NO in S14), the target position is set to the next position (S12), and the steps S11 and S13 are executed at the positions after setting.

If the step S11 has been executed at all the positions (YES in S14), it is determined whether there is a position where the light amount variation pattern is not constructed, that is, it is determined whether there is a faulty position (position for interpolation) where the light amount variation pattern needs to be constructed by interpolation. Further, if there is no faulty position that requires interpolation (NO in S15), the step S19 to be described below is executed.

In the case of the execution color yellow (Y), if there is a faulty position that requires interpolation (YES in S15), construction processing by interpolation is executed (S16). In the construction processing by interpolation, the density variation pattern data for sleeve rotation cycle at the faulty position is constructed based on the density variation pattern data for sleeve rotation cycle at another excellent position. Further, the density variation pattern data for photoconductor cycle at the faulty position is constructed based on the density variation pattern data for photoconductor rotation cycle at another excellent position. The light amount correction pattern data for sleeve cycle is constructed based on the constructed density variation pattern in the sleeve rotation cycle at the positions "a" to "e" for the execution color yellow (Y). The light amount correction pattern data for photoconductor cycle is constructed based on the constructed density variation pattern in the photoconductor rotation cycle at the positions "a" to "e" for the execution color yellow (Y).

After that, it is determined whether a series of processing flow for all colors has been executed (S19). If the series of processing flow has been executed (NO in S19), the execution color is sequentially changed to the next color, i.e., cyan (C), magenta (M), and black (K) (S20), and the processing flow of S2 to S19 is executed. If the series of processing flow has been executed (YES in S19), the series of construction processing illustrated in FIG. 17 is terminated.

In the print job after the construction processing illustrated in FIGS. 17 and 18 is executed, if the executable flag is set, the variation processing is executed. Thus, the variation processing is performed on the light amount of writing light in the first area, the second area, the third area, the fourth area, and the fifth area in each of the photoconductors 20Y, 20C, 20M, and 20K by superimposing the reference light amount and the superimposed light amounts based on the light amount correction pattern data. As illustrated in FIG. 13, the first area, the second area, the third area, the fourth area, and the fifth area are areas including the position "a", the position "b", the position "c", the position "d", and the position "e", respectively.

On the other hand, in the print job, if the execution flag is reset, the execution of the variation processing is canceled. As a result, the light amount of writing light in the first area, the second area, the third area, the fourth area, and the fifth area in each of the photoconductors 20Y, 20C, 20M, and 20K is maintained constant at the reference light amount.

In this manner, FIGS. 17 and 18 illustrate an example where, when any one of the positions ("a" to "e") exceeds the allowable number (predetermined number) of continuous faulty positions, the light amount variation processing at all the positions is canceled. However, the faulty position may be detected to be faulty only at a specific position when one of the reflective optical sensors moves in the main-scanning direction. The construction processing can also be applied to such a mobile sensor.

The light amount variation processing may be canceled only when the number of continuous faulty positions exceeds the allowable number of continuous faulty positions, and the light amount variation processing may be executed at the other positions.

If a reflective optical sensor detection faulty position is detected, information indicating the faulty position may be sent to a network host by warning display or warning sound via a panel of the image forming apparatus or a network connected to the image forming apparatus.

In a case where an uneven resistance in the peripheral direction occurs in the charging roller 71Y (see FIG. 3), even when the photoconductor is charged under the condition that a constant charging bias is applied to the charging roller, uneven charging due to the uneven resistance occurs in the photoconductor. As a result, an unevenness in the cycle of the image density of a halftone portion due to the uneven charging occurs. Accordingly, the light amount of writing light may be periodically varied depending on the rotation phase of the charging roller.

Next, an execution example in which a more characteristic structure is added to the image forming apparatus according to the present embodiment will be described. Unless otherwise noted, the structure of the image forming apparatus in the execution example is similar to that of the present embodiment.

In the density variation pattern in the sleeve rotation cycle and the density variation pattern in the photoconductor rotation cycle, when a deviation maximum value, which is a difference between a maximum value within a cycle and a target toner adhesion amount, exceeds a predetermined threshold, if the light amount variation processing is not executed, the density variation amount exceeds an allowable range. Accordingly, a conspicuous image of uneven density is formed. Therefore, when it is determined that the light amount variation processing is not executed in the executability determination processing and the deviation maximum value of the toner adhesion amount at an excellent position exceeds the threshold, a conspicuous image of uneven density is formed in the subsequent print job. Depending on the deviation maximum value, the occurrence of uneven density can be suppressed when the light amount correction pattern data is constructed by interpolation for faulty positions and the light amount variation processing is executed, regardless of whether the number of continuous faulty positions exceeds the allowable number of continuous faulty positions.

Therefore, in the image forming apparatus according to the embodiment, even when the number of continuous faulty positions exceeds the permissible continuous number, among the plurality of excellent positions, the maximum deviation amount of the toner adhesion amount is equal to or larger than the predetermined threshold value or the threshold value If there is even one that exceeds the light amount fluctuation processing is performed. Therefore, for all faulty positions, the density variation pattern data for sleeve rotation cycle at the faulty positions is constructed based on the density variation pattern data for sleeve rotation cycle at excellent positions, and the light amount correction pattern data for sleeve cycle is constructed based on the result. Further, the density variation pattern data for photoconductor rotation cycle at the faulty positions is constructed based on the density variation pattern data for photoconductor rotation cycle at excellent positions, and the light amount correction pattern data for photoconductor cycle is constructed based on the result.

Figure 21:
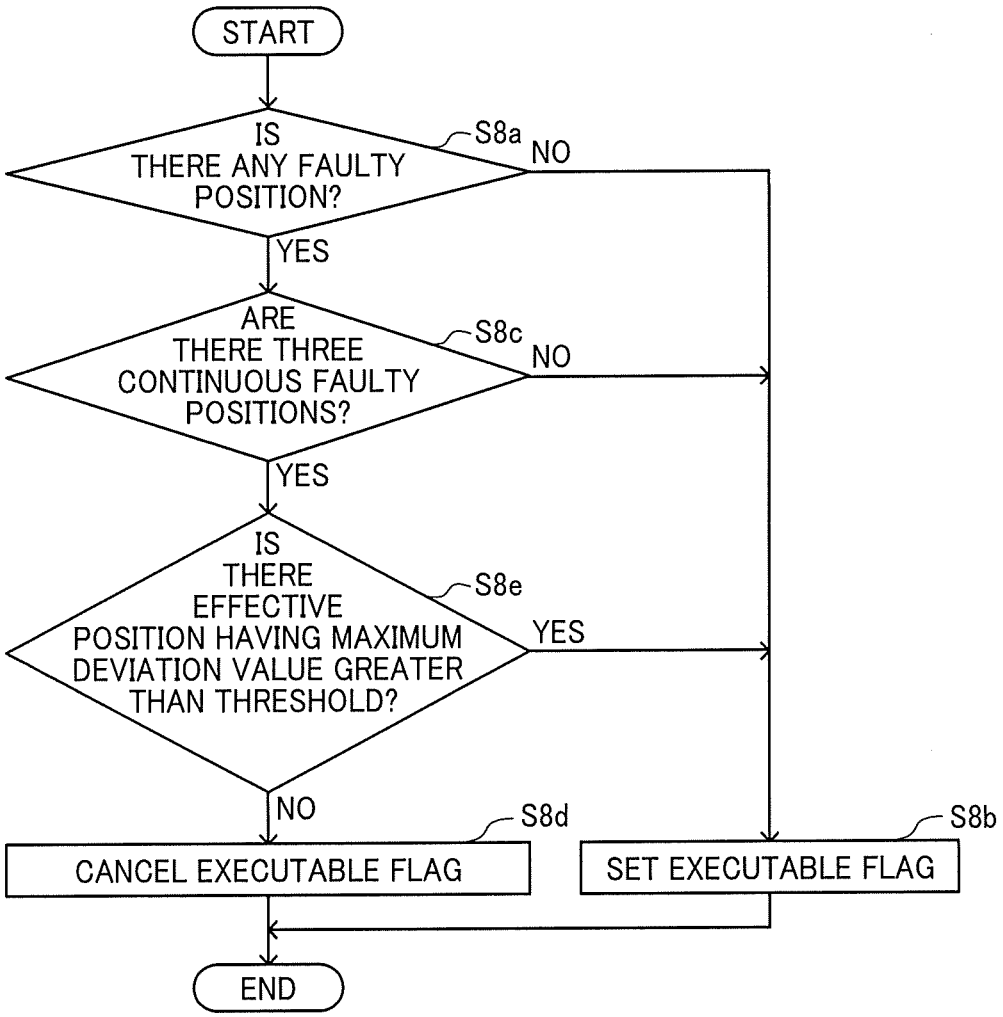
FIG. 21 is a flowchart illustrating a processing flow of executability determination processing performed by the controller of the image forming apparatus according to an embodiment.

FIG. 21 is a flowchart illustrating a detailed processing flow of the executability determination processing executed by the image forming apparatus in the execution example. In the executability determination processing (S8 in FIG. 17) executed in the image forming apparatus in the execution example, the detailed processing flow illustrated in FIG. 21 is executed instead of the detailed processing flow illustrated in FIG. 18.

FIG. 21 differs from the present embodiment (FIG. 18) in that, even when three or more continuous faulty positions are present (YES in S8*c*), if there is a valid position where the deviation maximum value of the toner adhesion amount exceeds the threshold (YES in S8*e*), the execution flag is set and it is determined whether to execute the light amount variation processing. In this structure, it is possible to avoid the occurrence of a significant uneven density due to the process in which the construction of the light amount correction pattern data by interpolation is canceled to stop the light amount variation processing, even when a deviation in the toner adhesion amount is extremely large.

Figure 22:
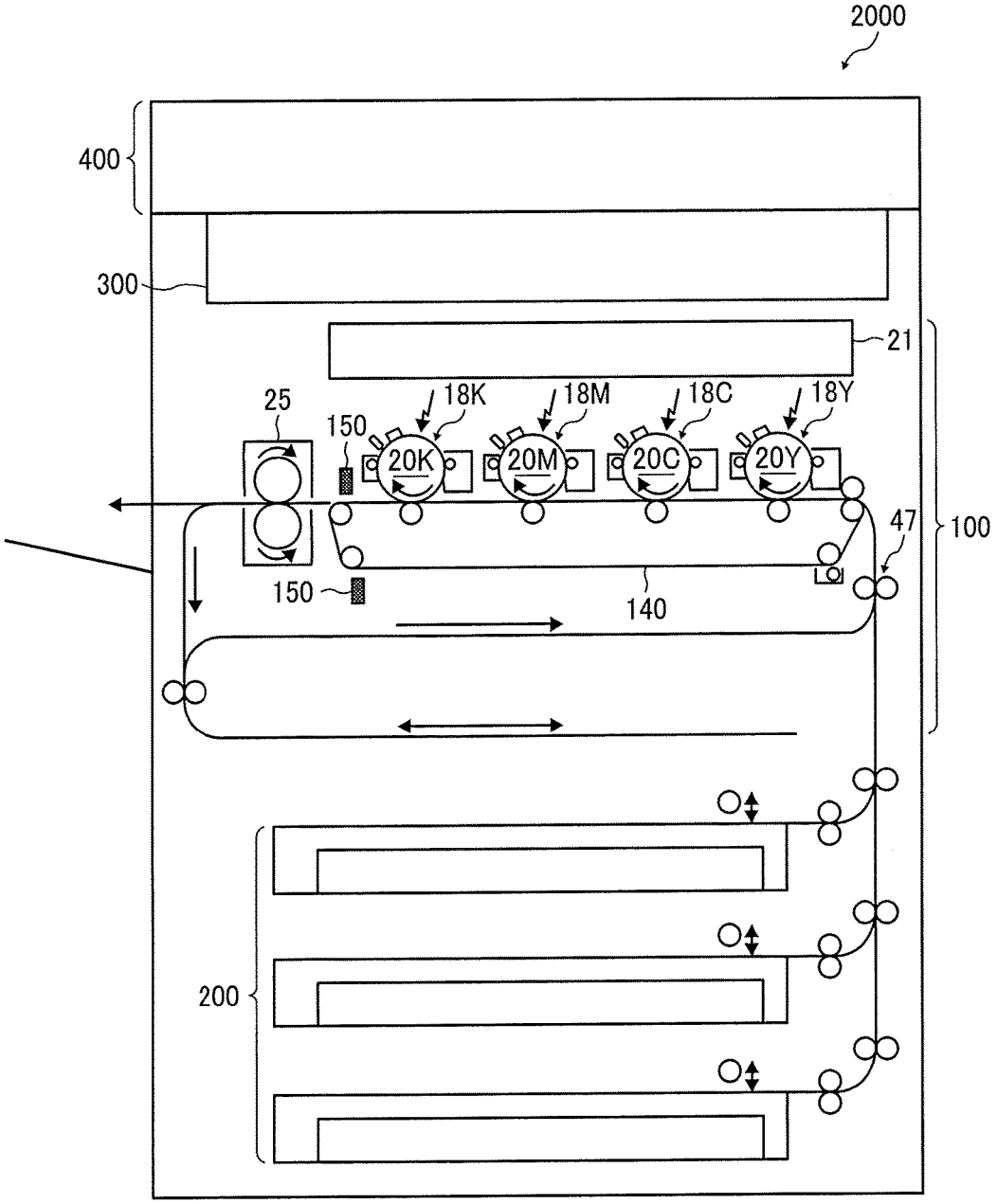
FIG. 22 is a schematic configuration diagram illustrating the image forming apparatus according to a variation.

FIG. 22 is a schematic configuration diagram illustrating the image forming apparatus according to a variation. In the image forming apparatus 2000 illustrated in FIG. 22, a belt member that is caused to move endlessly is not an intermediate transfer belt, but is a sheet conveyance belt 140. Like the intermediate transfer belt of the image forming apparatus 1000 according to the above-described embodiment, the sheet conveyance belt 140 contacts the photoconductors 20Y, 20C, 20M, and 20K and forms primary transfer nips for Y, C, M, and K.

The recording sheet fed toward the upper surface of the sheet conveyance belt 140 by the registration roller pair 47 sequentially passes through the primary transfer nips for Y, C, M, and K along with the endless movement of the belt in a state where the recording sheet is held on the upper surface of the belt. As a result, the Y, C, M, and K-toner images on the photoconductors 20Y, 20C, 20M, and 20K are directly primarily transferred onto the recording sheet.

The above examples are illustrated by way of example only, and provides specific effects for each of the following aspects First Aspect According to a first aspect, an image forming apparatus (e.g., the image forming apparatus 1000) includes a writing member (e.g., the laser writing device 21) that writes a latent image onto latent image bearers (e.g., the photoconductors 20C, 20K, 20M, and 20Y), and a detection device (e.g., the optical sensor unit 150 including the first reflective optical sensor 151*a*, the second reflective optical sensor 151*b*, the third reflective optical sensor 151*c*, the fourth reflective optical sensor 151*d*, and the fifth reflective optical sensor 151*e*) that detects, at a plurality of positions, a density of a toner image obtained by developing the latent image. The image forming apparatus corrects a writing intensity (e.g., writing light amount) of the writing member to correct an uneven density from a detection value of the detection member. The image forming apparatus determines whether each of the detection values of the detection member is pass or fail, and when the detection value is fail, the writing intensity at the detected position is corrected based on the detection value corresponding to a position where the detection value indicates pass, instead of executing the correction of the writing intensity based on the fail detection value, the position where the detection value indicates pass being different from a detection position where the detection value is fail.

In the first aspect, the correction of the writing intensity based on the detection value, which is not good, among the detection values at a plurality of positions obtained by the detection member is not executed, thereby making it possible to suppress the uneven density by correcting the writing intensity of the latent image, even when there is a density detection value including a measurement error.

Second Aspect

According to a second aspect, in the first aspect, a density variation pattern representing a periodic variation pattern of the density is analyzed based on the detection value, and the quality of the detection value is determined based on a variation in a value at the same point in each revolution within a cycle. In this structure, it is possible to accurately determine whether a measurement error is included or not based on the magnitude of the variation.

Third Aspect

According to a third aspect, in the second aspect, the detection member is structured such that the density at the plurality of different positions (e.g., the positions "a" to "e") in an orthogonal direction perpendicular to a movement direction on a surface of each of the latent image bearers, and the writing intensity with respect to the plurality of positions on the latent image bearers is corrected based on the detection values corresponding to the positions. In this structure, the occurrence of a periodic uneven density at the plurality of different positions in the orthogonal direction can be suppressed.

Fourth Aspect

According to a fourth aspect, in the third aspect, the density variation pattern is a pattern that varies in synchronization with a cycle of a revolution movement on the surface of each of the latent image bearers, or on the surface of each of developer bearers (e.g., the developing sleeves 81C, 81K, 81M, and 81Y) bearing developer for developing the latent image, and the variation is a variation in a value at the same point in each revolution. In this structure, the occurrence of an uneven density in synchronization of the revolution movement on the surface of each of the latent image bearers, or the occurrence of an uneven density in synchronization with the revolution movement of the developer bearers can be suppressed.

Fifth Aspect

According to a fifth aspect, in the third or fourth aspect, for the position corresponding to the detection value for which the detection result indicates fail, data is constructed based on the detection value for which the detection result indicates good, without executing the construction of the data for correcting the writing intensity based on the detection value. In this structure, for the position corresponding to the detection value for which the determination result indicates fail among the plurality of positions on the latent image bearers, the density variation pattern can be predicted based on the detection value which is detected at another position and for which the determination result indicates good.

Sixth Aspect

According to a sixth aspect, in the fifth aspect, for the position corresponding to the detection value for which the determination result indicates fail, the data is constructed based on the detection value which is obtained at the position adjacent to the position and for which the determination result indicates good. In this structure, for the position corresponding to the detection value for which the determination result indicates fail, the occurrence of an uneven density can be suppressed with a high accuracy based on the detection value which is detected at the adjacent position and for which the determination result indicates good.

Seventh Aspect

According to a seventh aspect, in the sixth aspect, in a case where the number of continuous positions for which the determination result indicates fail as to the quality of the detection value is equal to or greater than a predetermined number in the orthogonal direction, or more than the predetermined number of the positions are continuously present, the correction of the writing intensity with respect to the positions is not executed. In this structure, it is possible to avoid a deterioration in the uneven density due to the correction of the writing intensity based on the detection value in which the actual uneven density is not accurately reflected for the position corresponding to the detection value for which the determination result indicates fail.

Eighth Aspect

According to an eighth aspect, in the seventh aspect, in a case where the number of continuous positions for which the determination result indicates fail as to the quality of the detection value is equal to or greater than the predetermined number in the orthogonal direction, or more than the predetermined number of the positions are continuously present, the correction of the writing intensity for all the plurality of positions is not executed. In this structure, the control content can be simplified and the cost of the control device can be reduced as compared with the case of individually determining whether or not to correct the writing intensity for each of the plurality of positions.

Ninth Aspect

According to a ninth aspect, in the eighth aspect, even in a case where the number of the positions for which the determination result indicates fail as to the quality of the detection value is equal to or greater than the predetermined number in the orthogonal direction, or more than the predetermined number of the positions are continuously present, when the detection values obtained at the plurality of positions include the detection value in which a density variation maximum value is equal to or greater than a threshold, or exceeds the threshold, the correction of the writing intensity is executed based on the detection value for which the detection result indicates good for all the plurality of positions. In this structure, it is possible to avoid the occurrence of an uneven density due to cancellation of the writing intensity variation processing, even when deviation maximum value from the image density target value is equal to or greater than the threshold, or exceeds the threshold.

Tenth Aspect

According to a tenth aspect, in any one of the first to ninth aspects, the toner image from which the uneven density is detected is a toner image with a single image density. In this structure, an uneven density can be detected based on the result of detecting the image density in the entire area of the toner image.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a latent image bearer;

a writing device configured to write a latent image onto the latent image bearer;

a detection device configured to detect, at a plurality of positions, a density of a toner image obtained through development of the latent image; and a controller configured to correct a writing intensity of the writing device to correct an uneven density based on detection values of the detection device, the controller configured to determine whether each of the detection values of the detection device is pass or fail, the controller configured to correct, in response to a determination that a detection value of the detection values is fail, the writing intensity based on another detection value of the detection values determined to be pass at a position different from a position at which the detection value is determined to be fail, instead of correcting the writing intensity based on the detection value determined to be fail.

2. The image forming apparatus according to claim 1, wherein the controller analyzes, based on the detection values, a density variation pattern representing a periodic variation pattern of the density and determines whether each of the detection values is pass or fail based on a variation among detection values at a same point in each periodic cycle.

3. The image forming apparatus according to claim 2, wherein the detection device detects the density at the plurality of positions different in an orthogonal direction perpendicular to a movement direction of a surface of the latent image bearer, wherein the controller corrects the writing intensity at the plurality of positions on the latent image bearer based on the detection values corresponding to the plurality of positions.

4. The image forming apparatus according to claim 3, wherein the density variation pattern is a pattern that varies in synchronization with a cycle of revolution of a surface of the latent image bearer or a surface of a developer bearer to bear developer for developing the latent image, wherein the variation is a variation among detection values at a same point in each revolution of the surface of the latent image bearer or the surface of the developer bearer.

5. The image forming apparatus according to claim 3, wherein, for the position at which the detection value is determined to be fail, the controller constructs correction data for correcting the writing intensity based on said another detection value determined to be pass, instead of constructing the correction data based on the detection value determined to be fail.

6. The image forming apparatus according to claim 5, wherein, for the position at which the detection value is determined to be fail, the controller constructs the correction data based on the detection value that is determined to be pass and is obtained at a position adjacent to the position at which the detection value is determined to be fail.

7. The image forming apparatus according to claim 6, wherein, if a number of faulty positions at which detection values are determined to be fail is equal to or greater than a predetermined number in the orthogonal direction or the faulty positions continuously occur more than the predetermined number, the controller does not execute correction of the writing intensity for the faulty positions.

8. The image forming apparatus according to claim 7, wherein, if the number of the faulty positions is equal to or greater than the predetermined number in the orthogonal direction or the faulty positions continuously occur more than the predetermined number, the controller does not execute the correction of the writing intensity for all the plurality of positions.

9. The image forming apparatus according to claim 8, wherein, even if the number of the faulty positions is equal to or greater than the predetermined number in the orthogonal direction or the faulty positions continuously occur more than the predetermined number, the controller executes the correction of the writing intensity for all the plurality of positions based on the detection value determined to be pass when the detection values obtained at the plurality of positions include a detection value of which a maximum value of a deviation amount of the density is equal to or greater than a threshold or exceeds the threshold.

10. The image forming apparatus according to claim 1, wherein the toner image from which the uneven density is detected is a toner image with a single image density.

* * * * *